US009345285B2

(12) United States Patent
Lucas et al.

(10) Patent No.: US 9,345,285 B2
(45) **Date of Patent: *May 24, 2016**

(54) SHOE AND SOLE

(75) Inventors: Timothy David Lucas, Herzogenaurach (DE); Gerd Rainer Manz, Oberreichenbach (DE); Jan Hill, Groβenseebach (DE); Paul Leonard Michael Smith, Nürnberg (DE); John Whiteman, Nürnberg (DE)

(73) Assignee: adidas AG, Herzogenaurach (DE)

( * ) Notice: Subject to any disclaimer, the term of this patent is extended or adjusted under 35 U.S.C. 154(b) by 418 days.

This patent is subject to a terminal disclaimer.

(21) Appl. No.: 12/967,974

(22) Filed: Dec. 14, 2010

(65) Prior Publication Data

US 2011/0138652 A1 Jun. 16, 2011

(30) Foreign Application Priority Data

Dec. 14, 2009 (DE) ..... 10 2009 054 617
Dec. 1, 2010 (EP) ..... 10193336

(51) Int. Cl.

| | |
|---|---|
| ***A43B 3/10*** | (2006.01) |
| ***A43B 13/28*** | (2006.01) |
| ***A43B 21/30*** | (2006.01) |
| ***A43B 13/18*** | (2006.01) |
| ***A43B 7/32*** | (2006.01) |
| ***A43B 21/26*** | (2006.01) |
| ***A43B 21/32*** | (2006.01) |

(52) U.S. Cl.

CPC ..... *A43B 13/183* (2013.01); *A43B 7/32* (2013.01); *A43B 13/181* (2013.01); *A43B 13/184* (2013.01); *A43B 21/26* (2013.01); *A43B 21/30* (2013.01); *A43B 21/32* (2013.01)

(58) Field of Classification Search

CPC ..... A43B 5/18; A43B 7/144; A43B 13/12; A43B 13/181; A43B 13/183; A43B 13/184; A43B 21/26; A43B 21/30; A43B 21/32; A43B 7/14; A43B 7/18; A43B 7/181; A43B 7/183; A43B 7/184; A43B 7/186; A43B 7/188; A43B 7/32; A43B 13/00; A63B 25/10

USPC ..... 36/28, 27, 38, 7.8, 37

See application file for complete search history.

(56) References Cited

U.S. PATENT DOCUMENTS

| | | | | |
|---|---|---|---|---|
| 5,185,943 | A | 2/1993 | Tong et al. | |
| 5,367,790 | A | 11/1994 | Gamow et al. | |
| 5,713,140 | A * | 2/1998 | Baggenstoss | A43B 13/206 36/25 R |
| 6,449,878 | B1 | 9/2002 | Lyden | |

(Continued)

FOREIGN PATENT DOCUMENTS

| | | |
|---|---|---|
| DE | 10234913 | 2/2004 |
| DE | 102006015649 | 10/2007 |

(Continued)

*Primary Examiner* — Clinton T Ostrup
*Assistant Examiner* — Cameron A Carter
(74) *Attorney, Agent, or Firm* — Sterne, Kessler, Goldstein & Fox P.L.L.C.

(57) ABSTRACT

The present invention relates to shoe, in particular a sports shoe. The shoe includes a sole plate having in a forefoot area a plurality of leaf spring elements, wherein the sole plate and the plurality of leaf spring elements are manufactured as a single piece. Each of the plurality of leaf spring elements has one free end not connected with the sole plate.

32 Claims, 15 Drawing Sheets

(56) References Cited

U.S. PATENT DOCUMENTS

| | | | | |
|---|---|---|---|---|
| 6,601,042 | B1 | 7/2003 | Lyden | |
| D507,094 | S | 7/2005 | Lyden | |
| 6,925,732 | B1 | 8/2005 | Clarke | |
| 7,016,867 | B2 * | 3/2006 | Lyden | A43B 1/0081 36/37 |
| 7,100,308 | B2 | 9/2006 | Aveni | |
| 7,107,235 | B2 | 9/2006 | Lyden | |
| 7,549,236 | B2 * | 6/2009 | Dillon | A43B 13/184 36/25 R |
| 7,752,775 | B2 | 7/2010 | Lyden | |
| 7,770,306 | B2 | 8/2010 | Lyden | |
| 8,209,883 | B2 | 7/2012 | Lyden | |
| 2002/0038522 | A1 * | 4/2002 | Houser | A43B 7/1415 36/28 |
| 2003/0051372 | A1 * | 3/2003 | Lyden | A43B 1/0081 36/27 |
| 2005/0102857 | A1 * | 5/2005 | Yen | A43B 3/0052 36/28 |
| 2007/0209230 | A1 * | 9/2007 | Dillon | A43B 13/184 36/25 R |
| 2008/0016720 | A1 * | 1/2008 | Aveni | A43B 13/14 36/28 |
| 2008/0034615 | A1 * | 2/2008 | Nishiwaki | A43B 13/181 36/88 |
| 2008/0256827 | A1 * | 10/2008 | Hardy | A43B 13/181 36/27 |
| 2009/0126224 | A1 * | 5/2009 | Greene | A43B 13/206 36/27 |
| 2009/0178303 | A1 * | 7/2009 | Hurd | A43B 13/026 36/107 |
| 2009/0211114 | A1 * | 8/2009 | Ivester | A43B 13/181 36/103 |
| 2012/0216424 | A1 | 8/2012 | Lyden | |

FOREIGN PATENT DOCUMENTS

| | | |
|---|---|---|
| EP | 1 386 553 | 4/2004 |
| EP | 1 842 441 | 10/2007 |

* cited by examiner

220

221

222

223

224
10
20

211

212

213

214

SHOE AND SOLE

BACKGROUND OF THE INVENTION

1. Field of the Invention

The present invention relates to a sole and a shoe.

2. Background

Many modern sport shoes include shoe soles including foamed materials. For example, foams made from ethylene-vinyl-acetate (EVA) or polyurethane (PU) provide excellent cushioning properties for the loads arising in a shoe sole and are therefore used as a typical material for a midsole, which is arranged between an insole region and an outsole region of a shoe sole.

The lifetime of midsoles made from foamed materials, however, is rather limited. Irreversible degradations of the foamed materials under repeated compression and shearing loads on the sole are the reason that initially good cushioning properties are quickly lost. As a result, the sport shoe is "worn-out" and no longer meets the requirements of cushioning and biomechanically supporting the foot.

Furthermore, the dynamic properties of the foamed materials are strongly temperature dependent, which causes problems, in particular for sports (e.g., running) performed outdoors in cold weather, as the foamed material becomes hard, thus diminishing its cushioning properties. A further disadvantage of the use of foamed materials is the limited possibilities to adapt the cushioning properties to the size of a shoe and the expected weight of the wearer. Also, at smaller shoe sizes the surface portion of the foamed material is larger in relation to the volume, thus leading to lower temperatures of the foamed material (i.e., an undesirable hardness) when subjected to low-temperature environments. Modifications in sole constructions beyond the use of midsole layers of different thicknesses can only be realized, in mass production, through high effort and high cost.

Therefore, a number of approaches are known in the art to at least partly replace midsoles made from foamed materials.

For example, German Patent Application No. DE 10 2006 015 649 discloses arranging cushioning elements made from a thermoplastic urethane (TPU) below a sole area, which elements do not comprise foamed materials. U.S. Patent Application Publication No. 2007/0209230 further discloses sole constructions, wherein a plurality of curved spring elements is arranged in the sole area, all of which have essentially the same orientation. U.S. Pat. No. 5,185,943 shows a cushioning insert serving as reinforcement and being integrated into an otherwise common midsole of a shoe.

The known constructions, however, are not able to provide the advantageous cushioning properties of a new midsole made from foamed materials. Furthermore, the constructions mentioned in the last two documents are very complex to manufacture and for this reason are not practically used.

Further, U.S. Patent Application Publication No. 2002/0038522 A1 describes soles with cavities in which support members are placed that return towards their original shape when deflected by an external force. U.S. Pat. No. 6,925,732 B1 describes a sole structure with a frame element. The frame element extends around a heel portion and serves as a spring element in combination with the midsole. Finally, U.S. Patent Application Publication No. 2009/0178303 A1 describes a sole assembly with an upper plate and a lower plate in a forefoot portion of the sole assembly, and a plurality of lower plate arms curving downwardly from the upper plate.

Embodiments of the present invention are therefore based on the problem of providing a sole construction that can be easily manufactured, that uses minimal foamed materials, and that can be economically manufactured in order to at least partly overcome the above-mentioned disadvantages of the art.

BRIEF SUMMARY OF THE INVENTION

According to an exemplary embodiment of the present invention, a sole for a shoe, in particular a sport shoe, includes at least one first leaf spring element having an essentially parallel orientation with respect to the longitudinal direction of the sole and at least one second leaf spring element being arranged in the forefoot part and being essentially orthogonally oriented with respect to the longitudinal direction of the sole.

Leaf spring elements in a shoe sole can provide cushioning properties that have minimal disadvantages compared to the use of foamed materials. This applies, however, only if the leaf spring elements are optimally oriented for the expected loads. In contrast to a foamed material having isotropic cushioning properties, since the material is simply compressed under a load, leaf spring elements can provide optimal elastic support of the foot sole only if they are deflected in their preferred direction. An arrangement of the first leaf spring element in a longitudinal direction allows for elastically absorbing the ground reaction forces arising during heel strike. The at least one second leaf spring element in the forefoot part is, due to its orthogonal orientation, adapted to laterally balance the foot and to support the foot against misorientations such as pronation and supination (i.e., a tilting movement of the forefoot part to the medial and the lateral side, respectively).

In contrast to a midsole made from a foamed material, the first and second leaf spring elements of the present invention can be made from materials having a long lifetime and minimal temperature dependency. Furthermore, the first and the second leaf spring elements can be easily adapted to different shoe sizes and the correspondingly expected weight of the wearer of the shoe.

A particularly advantageous support and guidance function of the sole is achieved if at least a pair of second leaf spring elements is arranged in the forefoot part such that they extend from the medial to the lateral side of the forefoot part of the sole. In this preferred embodiment support of the foot by the leaf spring elements is achieved on both the lateral side as well as the medial side. This can be achieved by different arrangements, for example by a pair of separate second leaf spring elements, or also by a pair of second leaf spring elements that are connected to each other, wherein one leaf spring element extends from the lateral rim up to approximately the center of the forefoot part, and the other leaf spring element extends from the center to the medial rim of the forefoot part. Symmetric partitioning, however, is not required.

In one preferred arrangement, a plurality of pairs of second leaf spring elements extend in parallel from the medial to the lateral side of the forefoot part of the sole. This arrangement is capable of withstanding particularly well the loads arising during push-off with the forefoot part. Further, it provides deformation properties that essentially correspond to the dynamic properties of a foamed material as it is typically used in the midsole of the forefoot part.

Preferably, the first and/or the second leaf spring element includes a non-planar form so that the leaf spring element extends from an insole region to an outsole region. Accordingly, the curved leaf spring elements start from the insole region (arranged close to the foot), bridge the midsole region (which is typically filled with a foamed midsole) and extend to the outsole region (i.e. the region of the sole arranged at the ground arranged at a greater distance from the foot). This preferred embodiment facilitates an almost unhindered elastic deflection of the leaf spring elements between the insole region and the outsole region of the sole. It is particularly preferred if the first and/or the second leaf spring element has in each case a convex curved region and a concave curved region.

In one embodiment two opposing first leaf spring elements are provided that preferably extend in the region of the arch of the foot. The opposing orientation of the leaf spring elements reinforces this part of the sole in which a sufficient support of the foot is of primary importance to avoid injuries.

Particularly preferred is an arrangement of the sole including at least one sole plate wherein the at least one first leaf spring element and the at least one second leaf spring element are arranged below the sole plate. In other words, in this embodiment the first and the second leaf spring elements extend in the space between the sole plate and the ground (or outsole layer 40, if provided). The sole plate and the leaf spring elements can be provided as a single piece, for example by injection moulding. This manufacturing technique may allow easy production of the sole design of embodiments of the present invention at very low costs. The described sole plate can be advantageously used together with the integrated first leaf spring element even if the forefoot part of the sole has a different design than explained above.

Preferably, the sole plate extends essentially over the complete length of the sole and includes an optional heel cup that encompasses the heel like a bowl. Support of the foot is of particular importance if discrete leaf spring elements are used instead of the known homogenous midsole made from a foamed material. The three-dimensionally shaped sole plate assures on the one hand that the leaf spring elements do not exert point loads on the foot sole. In addition, it avoids unintended rolling of the foot's ankle during the gait cycle. Furthermore, the sole plate, which has in some embodiments an extension over essentially the complete length of the sole, may serve as a chassis or frame for the shoe.

Each leaf spring element includes preferably an end that is connected to the sole plate and an end not connected to the sole plate, wherein the ends of a plurality of leaf spring elements not connected to the sole plate may be interconnected.

A first cushioning element may be arranged between at least one end of a leaf spring element that is not connected to the sole element (referred to as the "free end") and the sole plate to selectively influence the dynamic properties of the sole. For this purpose, a first cushioning element can for example be arranged on the upper surface of the leaf spring element and/or on the lower surface of the sole plate, for example by gluing. The first cushioning element may be a structural cushioning element that is preferably free from foamed material.

A second cushioning element, which may be made from a foamed material, is preferably arranged such that it is deformed only after a preferably predefined deflection of the first and/or the second leaf spring element. The described arrangement of the first and the second cushioning elements allows an exact adaptation of the dynamic properties of the sole to the expected loads. When a load is applied to the sole the leaf spring elements provide an essentially elastic restoring force upon deflection, whereas the cushioning elements cushion both the deflection movement as well as the restoring movement. Thereby peak loads on the foot sole and the joints of the wearer of the shoe are avoided. The second cushioning element, which is preferably a foamed cushioning element, is preferably only deformed after a predefined deflection of the first and/or the second leaf spring element. As a result, the above described degradation of this material occurs substantially slower than in known sole constructions wherein each load directly leads to a deformation of the foamed midsole material.

According to a further aspect the present invention relates to a shoe with a sole according to the above-described embodiments. Such a shoe, which may for example be used as a sport shoe, has a substantially longer lifetime with constant cushioning properties than a shoe having a foamed midsole. It is particularly preferred if the shoe has a shoe upper that is at least partially directly connected to the above described sole plate. This results in a particularly stable and direct connection between the shoe upper and the leaf spring elements of the sole construction. The foot is safely retained between the upper and the sole plate of the shoe so that a cushioning function of the leaf spring elements reacts directly on the foot.

BRIEF DESCRIPTION OF THE FIGURES

Aspects of the present invention are described in more detail with reference to the accompanying figures.

DETAILED DESCRIPTION OF THE INVENTION

In the following, presently preferred embodiments of the invention are further explained with reference to a sole construction for a sport shoe. The present invention may also be used in other types of shoes. The particular advantages of a lifetime without changes of the dynamical properties of the shoe and the high number of possibilities to adapt the cushioning properties of the shoe to the size and the requirements of the wearer of the shoe are, however, particularly important for sport shoes.

Figure 1:
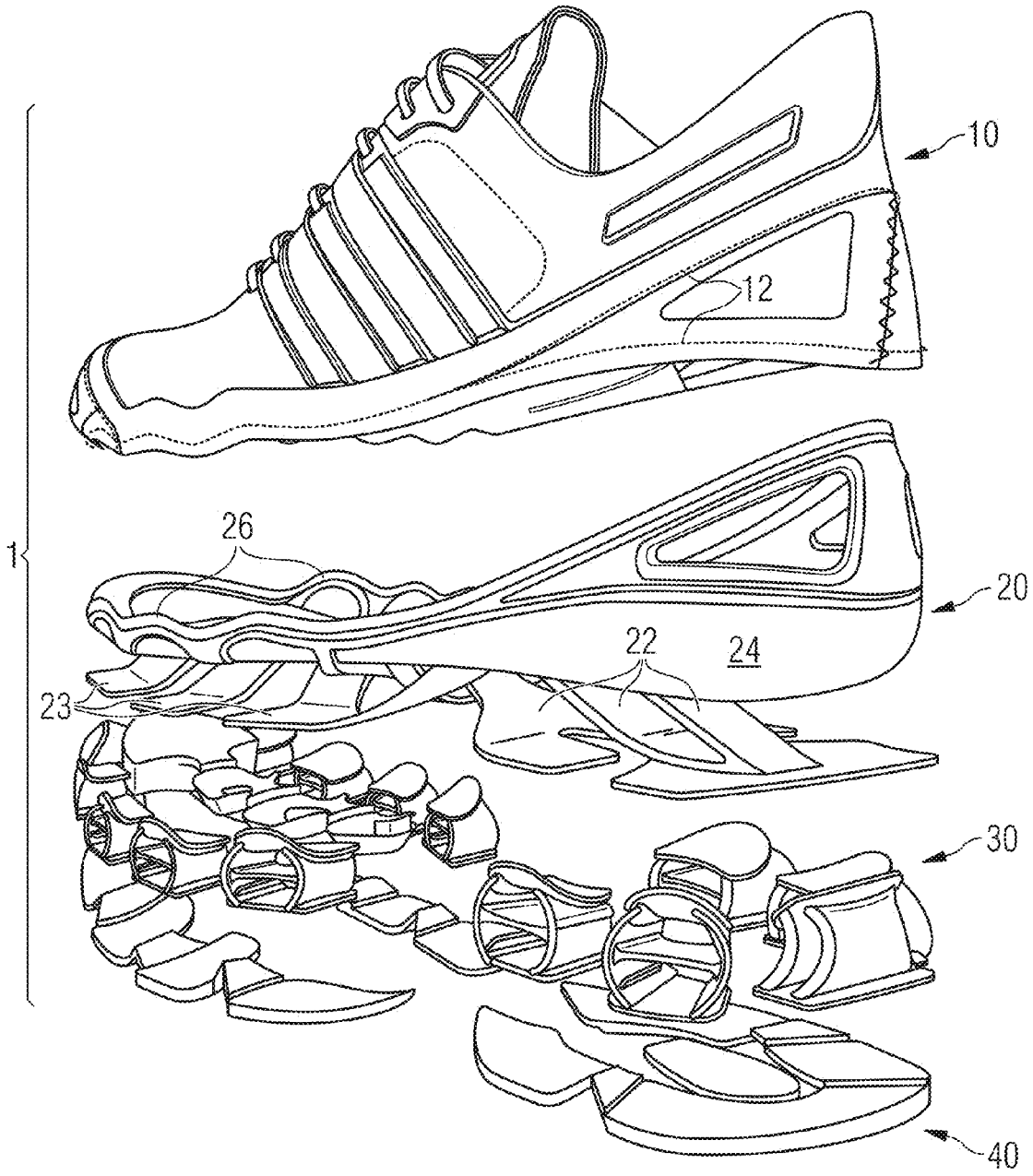
FIG. 1 is an exploded view of a shoe having a sole according to an embodiment of the present invention.

FIG. 1 shows an exploded view of an embodiment of a shoe 1 according to the present invention. As can be seen, the shoe 1 includes a shoe upper 10, a sole plate 20, a group of first cushioning elements 30, and the outsole layer 40. Although features of the four groups of components are discussed together with reference to the embodiment of FIG. 1, is to be understood that their respective components are substantially independent from each other. Features discussed below need not necessarily be jointly realized but can be individually realized or realized in other combinations to create a shoe 1 that at least partially overcomes the above-mentioned disadvantages of the art.

A three-dimensionally shaped sole plate 20 is arranged below the shoe upper 10. The sole plate 20 serves as a chassis or frame for the overall shoe construction and is preferably made as a single piece including the plurality of first and second leaf spring elements 22 and 23 and a heel cup 24, for example by injection molding a suitable plastic material such as TPU. It is also conceivable to use polyamide or composite materials that may be reinforced with fibres. In doing so, the fibres are preferably inserted in a flow direction. If different materials are to be used, however, for example a harder synthetic material for the sole plate 20 and a more flexible material for the leaf spring elements 22 and 23, multi component injection molding may be used for cost-effective manufacture.

The shoe upper 10 is attached to the upper rim 26 of the sole plate 20, preferably by sewing along a seam 12 or by other attachment techniques such as, for example, gluing and welding. The sole plate can also be directly injected to an insole of the shoe upper (if available) or can be glued to it.

As can be seen from FIGS. 3-10, the first cushioning elements 30 are arranged below the sole plate 20 but above the free ends of the first and second leaf spring elements 22 and 23.

In the heel part the sole plate 20 and the shoe upper 10 overlap. This reinforces the heel part without the need for other constructive measures. The foot of a wearer of the shoe 1 (not shown in FIG. 1) can directly rest on the upwardly bound top side of the sole plate 20, wherein a thin inlay sole, for example a sock liner (not shown in FIG. 1), can be arranged on top of the sole plate 20 to improve wearing comfort.

Both the heel cup 24 (which securely encompasses the foot from below and three sides) and the rim 26 (which preferably extends up to the forefoot part) contribute to the stability of the shoe 1. This applies to the constructive stability of the shoe 1 itself, since the torsional stiffness of the sole plate 20 is increased. It applies also to the stability that the shoe 1 provides for the foot so that undue tilting of the foot away from the sole plate 20 is reliably avoided.

The plurality of leaf spring elements 22 and 23 have a lower surface that is in contact with the ground, either independently or through intervening elements such as outsole layer 40. The plurality of leaf spring elements 22 and 23 are arranged below the sole plate 20 between the above-mentioned insole region and an outsole region defined by the outsole layer 40. The leaf spring elements 22 and 23 therefore replace the midsole layer of a standard sole design. Loads acting on the shoe, for example during heel strike and during push-off with the forefoot part, cause an elastic deformation of the leaf spring elements 22 and 23 as explained in more detail below with reference to FIG. 2. In some embodiments the outsole is directly injection molded to the leaf spring elements.

It is advantageous if the leaf spring elements 22 and 23 are biased (i.e., the distance between the sole plate 20 and the free end of a leaf spring element after (i) the manufacture of the leaf spring element; and (ii) its assembly in the shoe, are different. Leaf spring elements 22 and 23 could either be assembled with such a bias so that the cushioning elements described below in detail have a tensile strain when not loaded (i.e., the distance between the sole plate 20 and the free end of the leaf spring element is larger after the manufacture than after the assembly). Thereby, cushioning is already provided even at the lowest load. Conversely, the cushioning elements can already be compressed by the leaf spring elements without any load having been applied to the sole (i.e., the distance between the sole plate 20 and the free end of the leaf spring element is smaller after the manufacture than after the assembly). Thereby, the tension within the material can be reduced by the deflection of the leaf spring elements. Moreover, the combination of differently biased leaf spring elements in different regions of the sole is also possible.

In a further embodiment (not depicted in the figures) several leaf spring elements are arranged on top of each other so that they are deflected together by a respective load.

First cushioning elements 30 are arranged between the free ends of the leaf spring elements 22 and 23 and the lower side of the sole plate 20. The first cushioning elements 30 cushion both the deformation movement of the leaf springs 22 and 23 when the sole is loaded, and the opposite movement when the leaf spring elements 22 and 23 spring back. For the above-mentioned reasons the first cushioning elements 30 are preferably not made from foamed materials. Instead, structural cushioning elements are preferably used as disclosed in, for example, German Patent Application Nos. DE 102 34 913 A1 or DE 10 2006 015 649 A1. In the embodiment shown in FIG. 1, which is also partially shown in the side view of FIG. 3 and the rear view of FIG. 4, each first cushioning element 30 includes two curved sidewalls 32 that are connected by a tension element 34. A pressure load on the first cushioning element 30 causes an increase in the curvature of the sidewalls 32 and a tension load on the interconnecting tension element 34. As a result, the described arrangement serves to efficiently transform a pressure load on the sole into a tension load.

Figure 3:
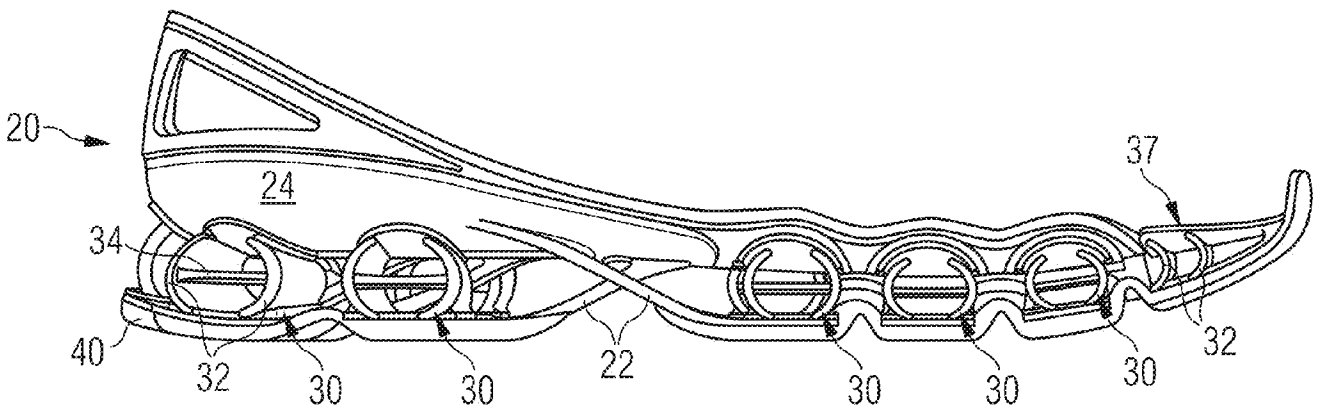
FIG. 3 is a side view of the sole plate and of the leaf spring elements of FIG. 2 with additional cushioning elements.
Figure 4:
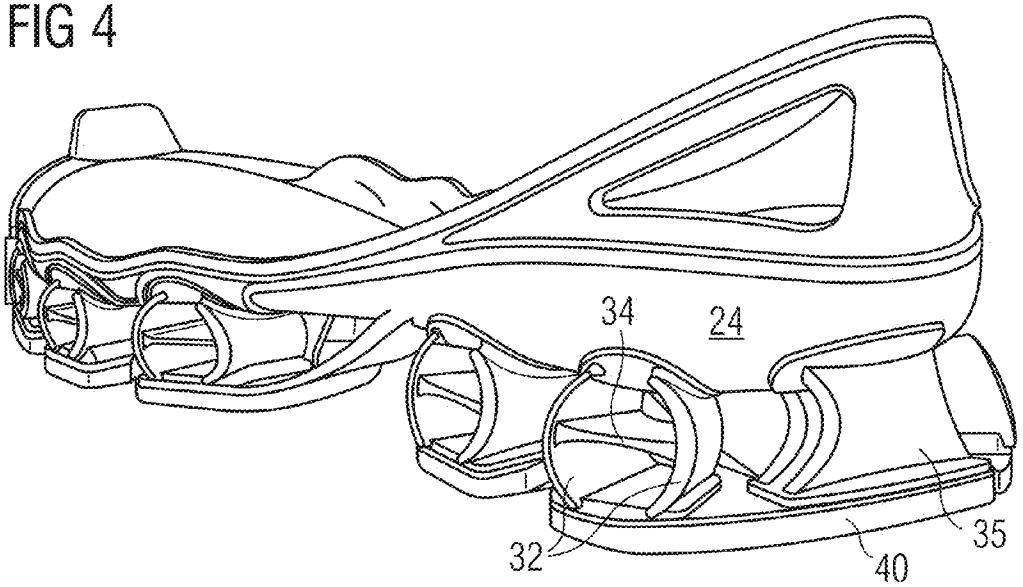
FIG. 4 is a rear view of the embodiment of FIG. 3.
Figure 5:
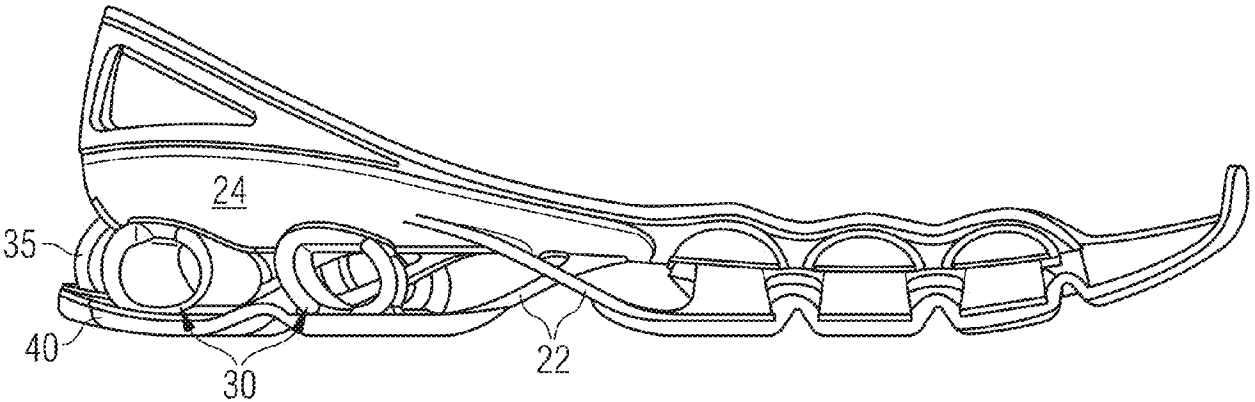
FIG. 5 is a side view of a sole plate, several leaf spring elements, and several cushioning elements in the heel part according to a further embodiment of the present invention.
Figure 6:
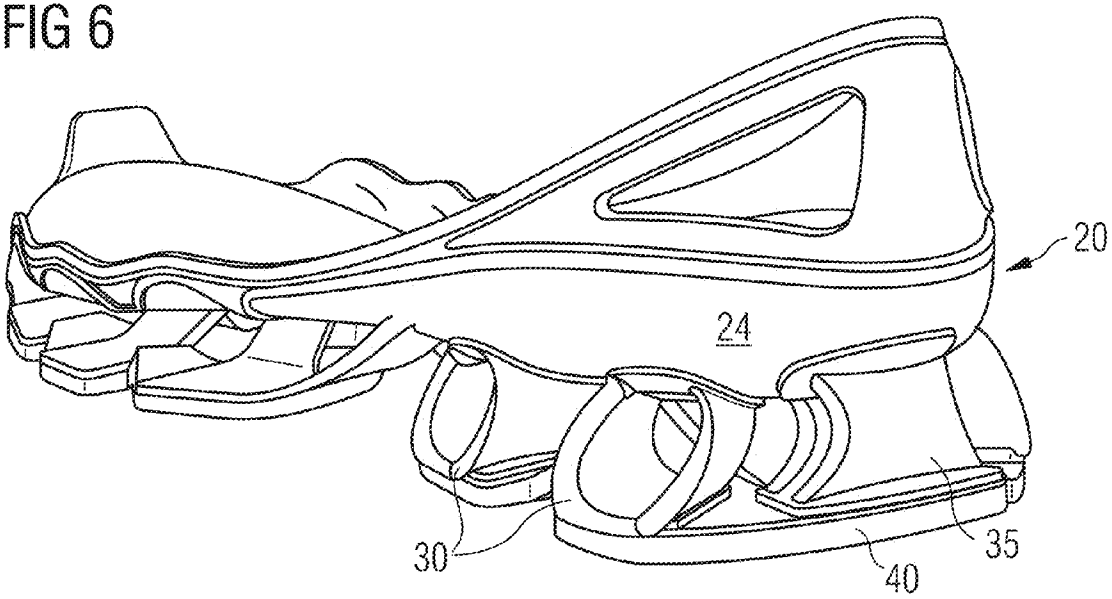
FIG. 6 is a rear view of the embodiment of FIG. 5.

Apart from the first cushioning elements shown in FIGS. 1, 3, and 4, other types of structural cushioning elements may be arranged between the free ends of the leaf spring elements 22 and 23 and the lower side of the sole plate 20. FIGS. 5 and 6 show examples of first cushioning elements 30, wherein the pressure load is transformed into a shearing movement. Here, the cushioning elements 30 have in their initial configuration a somewhat parallelogram-like cross-section with slightly curved side surfaces, which is further sheared when the distance between the sole plate 20 and the outsole layer 40 is decreased, as indicated by two dashed arrows in FIG. 5. If similar wall thicknesses are used, the cushioning elements of FIGS. 5 and 6 are softer than the cushioning elements of FIGS. 1, 3, and 4. A detailed inspection shows, however, that in the embodiment of FIGS. 5 and 6 an optional cushioning element 35 having no tension element can be used at the rear end so that it deforms under load by a shearing movement, wherein the front and the rear sidewalls 32 of the cushioning element 35 are bent in parallel. In the same manner cushioning element 37 at the front end of the sole (see FIG. 3) does not contain a tension element between the parallel sidewalls 32 and therefore provides a softer cushioning characteristic.

Instead of the described structural cushioning elements 30 it is also possible to use cushioning elements made from a standard midsole material, for example a foamed EVA. In contrast to conventional midsoles, a longer lifetime of the sole can be expected according to embodiments of the present invention since the foamed material must only cushion the deformation movement, whereas the actual restoring force against a deformation of the sole is provided by the elastically deflected leaf spring elements 22 and 23. In this respect the design is similar to a shock-absorber of a car, wherein separate constructive elements provide the restoring force (for example a steel spring) and the cushioning (oil). In contrast to the use of a homogenous midsole made from a foamed material, this separation allows both a longer lifetime and a more exact adjustment of the sole properties.

Although in the preferred embodiment a separate cushioning element 30 is assigned to each free end of a leaf spring elements 22 and 23, other arrangements are possible as well, wherein a single cushioning element 30 cushions the deflection of several leaf spring elements 22 and 23, or wherein several cushioning elements 30 are arranged next to each other or on top of each other between a free end of a single leaf spring element 23 or 22 and the lower side of the sole plate 20. Alternatively, cushioning elements 30 can be completely abandoned in a constructive design of the leaf spring elements 22 and 23. Furthermore, it is possible to releasably attach the cushioning elements 30 to the sole plate 20 and/or the free ends of the leaf spring elements 22 and 23 to replace one or more cushioning elements 30 in case of wear or for a selective adaptation of the cushioning properties, or for design purposes (e.g., to change the color). An arrangement is also possible (not shown) where the cushioning element 30 is only attached to one side, either at the free end of a leaf spring element 22 or 23 or to the sole plate 20, and wherein the cushioning element 30 has at its free end a distance from the leaf spring element 22 or 23 or from the sole plate 20, respectively. Thereby the leaf spring element 22, 23 can at first be deflected undamped by the cushioning element 30 since the cushioning element 30 is only compressed after a predefined deflection movement of the leaf spring element 22 or 23.

Independent from their particular arrangement, the cushioning elements 30 can be adhered between the sole plate 20 and the free ends of the leaf spring elements 22 and 23. Pad printing to apply the heated and fluidized adhesive is particularly advantageous. In this process, a punch or pad absorbs the adhesive in the form of a printed design and transfers it to the body to be printed. Thus, manual, time consuming application of adhesive can be automated, thereby saving time, costs, and adhesive. The quality of the bond can also be improved. Pad printing is particularly well suited for rough bodies since the punch or pad adapts to the background.

Figure 2:
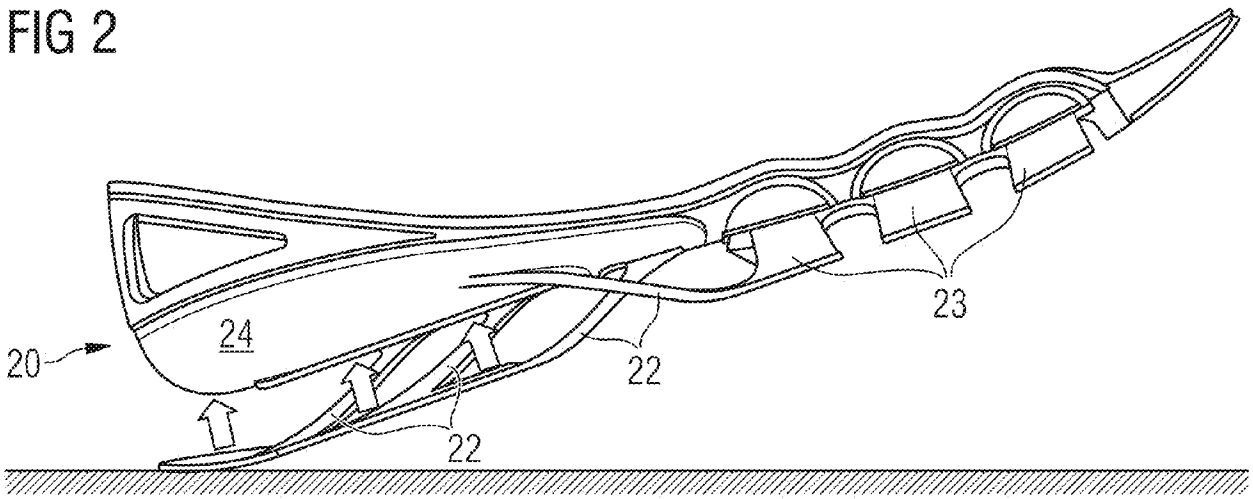
FIG. 2 is a side view of the sole plate and of the leaf spring elements of the shoe of FIG. 1.

FIG. 2 illustrates the preferred orientation and shape of the leaf spring elements 22 and 23, which extend downwardly from the sole plate 20 and are preferably integrally connected to the sole plate 20. Starting from the heel region below the heel cup 24 up to the mid-foot region below the arch of the foot, three leaf spring elements 22 are essentially oriented in a longitudinal direction of the sole. The indication "essentially" includes deviations from the longitudinal direction of the sole that may be caused by typical manufacturing techniques or tolerances. Intended deviations from an essentially longitudinal orientation, however, are also possible. The three leaf spring elements 22 are preferably oriented such that their free ends are directed to the heel. Two further first leaf spring elements 22, that are in the preferred embodiment arranged in the mid-foot region, have an opposite orientation so that their free ends are directed to the front. Such a crossed arrangement of the leaf spring elements 22 leads to a particular stiffening of the midsole region below the arch of the foot.

The free ends of several leaf spring elements 22 and 23 may be interconnected either directly or by the material of the outsole to provide a higher amount of structural integrity in certain areas of the sole. For example, the free ends of the two rearmost first leaf spring elements 22 in the embodiment of FIGS. 1 to 7 are interconnected whereas the first leaf spring elements 22 in the heel (closest to the midfoot) comprise two unconnected free ends.

Due to their specific orientation, the three rearmost leaf spring elements 22 can be easily deflected during heel strike as schematically shown in FIG. 2. The ground reaction force (indicated by the arrows in FIG. 2) acts on the free ends of the leaf spring elements 22 and deflects them in their preferred direction (i.e., essentially perpendicular to their orientation). The preferred curvature of the leaf spring elements 22 and 23 includes a change from a concave to a convex curvature (seen from below), allowing a simple integration of the leaf spring elements 22 and 23 into the sole plate 20 and providing the required space for an upward deflection of the free end. The inflection point of the curvature (i.e., the transition from a concave to a convex curvature of the leaf spring elements 22 and 23) is preferably arranged halfway between the lower side of the sole plate 20 and the outsole layer 40. Other shapes of the leaf spring elements 22 and 23 are conceivable, however, that provide on the one hand a good spring characteristic, and that provide on the other hand the distance that is necessary for a deflection in the space between the sole plate and the outsole layer. For example, the leaf spring elements 22 and 23 can be centrally attached to the sole plate 20, or they can run in an angled, curved, or linear shape from the lateral to the medial side of the sole plate 20, wherein the leaf spring element 22 or 23 is either attached at the medial or the lateral rim and has an angle with respect to the sole plate 20.

Figure 7:
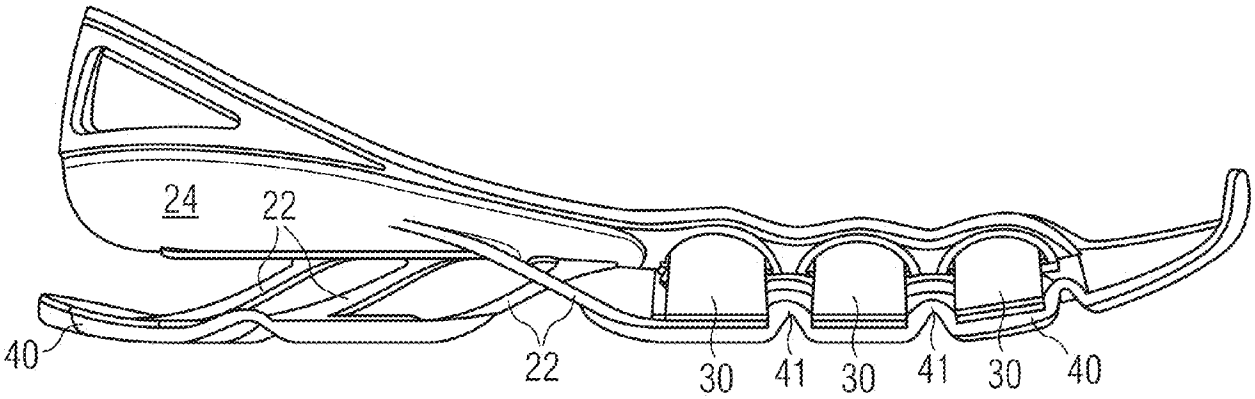
FIG. 7 is a side view of a further embodiment of the present invention, including several additional cushioning elements in the forefoot part.

The outsole 40 is preferably arranged below the cushioning elements 30. The outsole layer 40 primarily serves to provide a good grip on the ground and to protect against premature wear due to abrasion. The outsole layer 40 can include individual elements that are arranged below individual free ends of the leaf spring elements 22 and 23. It is also possible, however, that the outsole layer 40 extends over several leaf spring elements, as shown in FIG. 7. If so, the outsole layer 40 may include curved regions 41 between adjacent free ends of the leaf spring elements 22 and 23 allowing an individual deflection of individual leaf spring elements 22 and 23 without creating a noticeable tension within the outsole layer 40.

Figure 8:
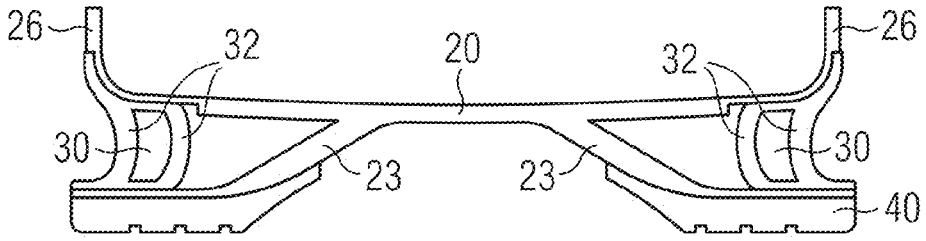
FIG. 8 is a cross-section of the forefoot part of the embodiment of FIG. 7.
Figure 9:
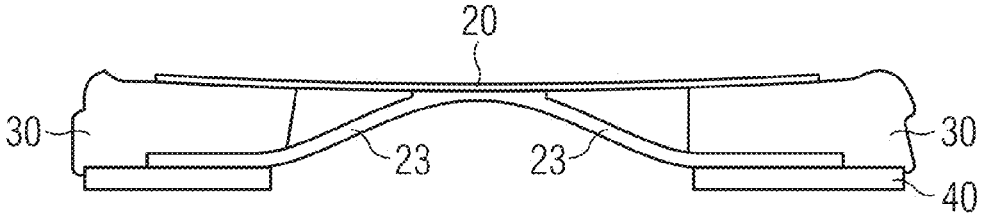
FIG. 9 is a cross-section through the forefoot part of a further embodiment of the present invention.
Figure 10:
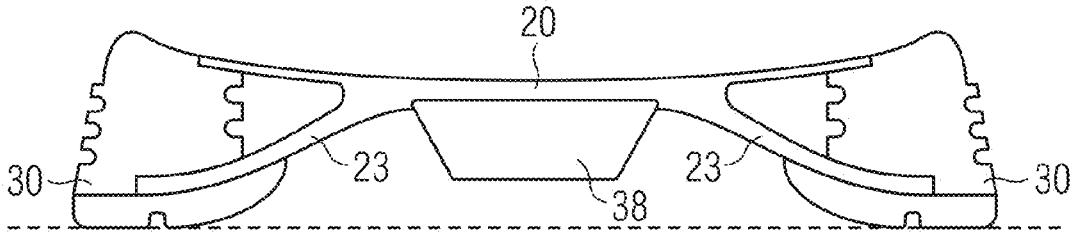
FIG. 10 is a cross-section through the forefoot part of a further embodiment of the present invention.

Whereas the cushioning of ground reaction forces is of primary importance during heel strikes, as shown in FIG. 2 it is, for the subsequent rolling-off phase, essential to correctly balance the foot for push-off with the forefoot part. The leaf spring elements 23 in this part of the sole are therefore preferably orthogonally arranged with respect to the leaf spring elements 22 of the heel and mid-foot part, and extend in pairs from the lateral to the medial side of the sole, as schematically shown in the cross-sections of FIGS. 8 to 10. Thereby, a leaf spring element extends in each case from the rim to approximately the center of the sole. FIGS. 8 to 10 furthermore illustrate that the above-described cushioning elements 30 may also here be arranged between the free ends of the leaf spring elements 23 and the bottom side of the sole plate 20. For example, the side view of FIG. 7 and the cross-section of FIG. 8 show the arrangement of cushioning elements 30 without a tension element between the sidewalls 32 that bend in parallel under load. The outer sidewalls 32 of the cushioning elements 30 include preferably an upward extension on the side leading to an overlap with the rim 26 of the sole plate 20 for a simple interconnection, for example by gluing or welding.

Preferably not only the outer side wall has an upward extension, but the side walls may be interconnected at their upper and lower ends so that that they can be securely adhered with the sole plate 20 and the free ends of the leaf spring elements 22 and 23. Thereby, the interconnection between upper ends of the side walls has an upward extension that extends beyond the rim of the sole plate 20 to avoid a lateral shift of the cushioning elements. It is also possible to not only connect the leaf spring elements 22 and 23 with the sole plate 20 but also with the shoe upper 10 so that deformations of the leaf spring elements 22 and 23 affect the properties of the shoe upper (e.g., the shoe upper may get tighter and wider). For example, the leaf spring element 22 or 23 could also have at its free end an extension vertical to the shoe upper that moves upwardly at a lateral deformation of the leaf spring element 22 or 23 along the shoe upper and thus provides additional lateral stability.

The cross-section of FIG. 9 shows another embodiment, wherein the sole plate 20 and the leaf spring elements 23 of the forefoot part are independently manufactured and only connected during assembly of the shoe, for example by gluing, welding, a (releaseably) mechanical bond, or other suitable methods. In the embodiment of FIG. 9, however, two leaf spring elements 23 are provided together and form an elastic component that extends from the medial to the lateral side of the forefoot part of the sole. An arrangement is also possible where the leaf spring elements 22 and 23 are not rigidly connected to the sole plate 20, but are only indirectly connected to the outsole layer 40 and the cushioning elements 30 with the sole plate 20, whereby a certain mechanical play is enabled between the leaf spring elements 22 and 23 and the sole plate 20.

FIG. 10 illustrates a further modification of the forefoot part. Here, a second cushioning element 38, which may, for example, be manufactured from a foamed material, is centrally or concentrically arranged. Under a minor load on the leaf spring elements 23, for example during normal walking, the second cushioning element 38 does not contact the ground (which is in FIG. 10 schematically indicated by the dashed line). Only under a heavy load on the forefoot part, for example the landing after a jump, are the leaf spring elements 23 deflected to such an extent that the second cushioning element 38 is compressed. With this progressive cushioning so-called "bottoming out" can be avoided (i.e., a failure of the cushioning of the sole under an extreme load). For shoes that are often subject to extreme loads, for example those used while playing basketball, a plurality of second cushioning elements 38 are preferably arranged between the spring arms of leaf spring elements 23 of the forefoot part.

Figure 11:
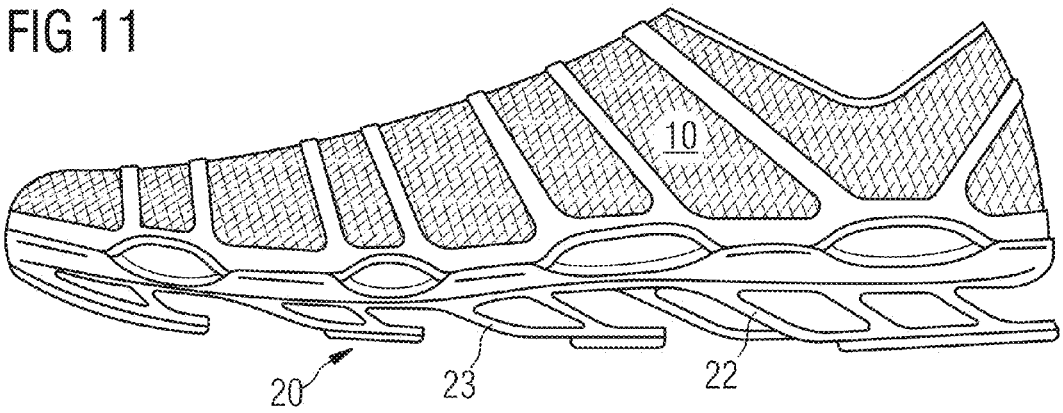
FIG. 11 is a schematic side view of a further embodiment of the present invention.
Figure 12:
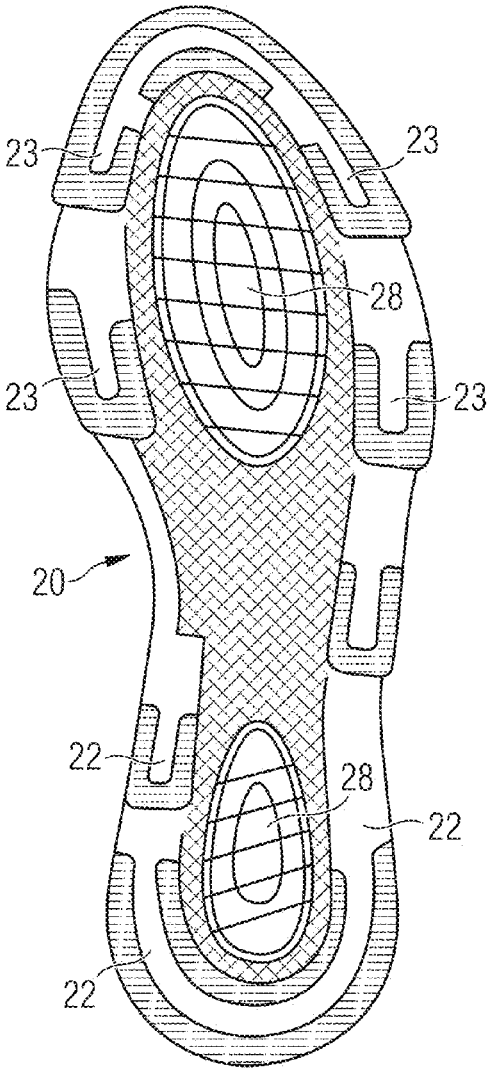
FIG. 12 is a bottom view of the embodiment of FIG. 11.

FIGS. 11 and 12 illustrate a further embodiment of an integral sole plate 20 including a plurality of integrated leaf spring elements 22 and 23. The orientation of the leaf spring elements 22 and 23 follows in this embodiment the border of the sole so that in the forefoot part the leaf spring elements 23 are almost parallel to the longitudinal axis of the shoe. For reducing the weight and/or for improved ventilation, the sole plate 20 may include smaller or larger cut-outs 28 as schematically shown in FIG. 12. Such cut-outs may also be used in other embodiments. By using a different number and/or by using different stiffnesses of the leaf spring elements 23 on the lateral and the medial side of the forefoot part (and/or in the heel part), misorientations such as pronation or supination may be minimized in the embodiment of FIGS. 11 and 12. Furthermore, cushioning elements may in this embodiment be arranged between the free ends of the leaf spring elements 22 and 23 (not shown in FIGS. 11 and 12).

Figure 13:
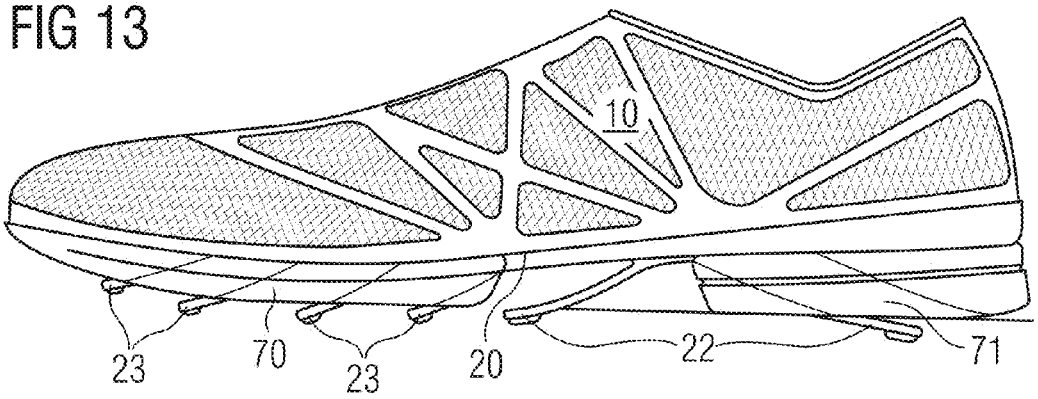
FIG. 13 is a schematic side view of a further embodiment of the present invention.
Figure 14:
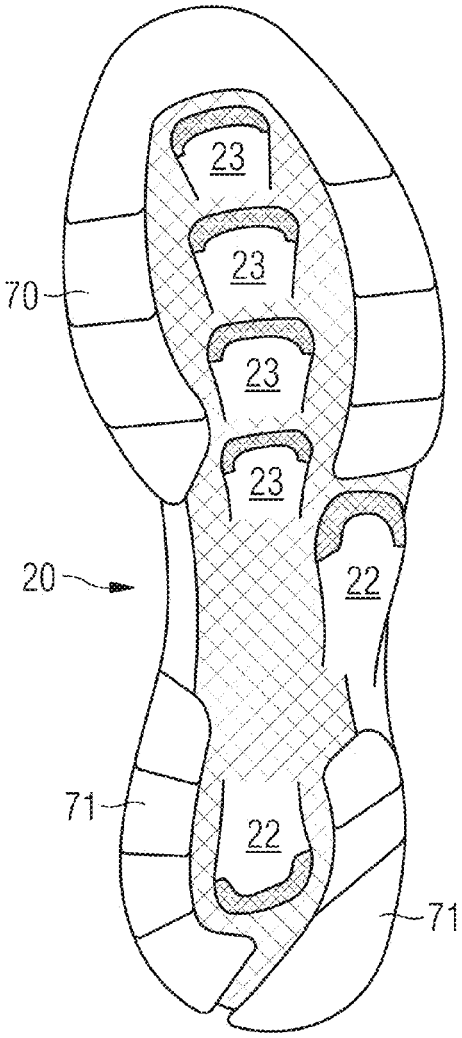
FIG. 14 is a bottom view of the embodiment of FIG. 13.

FIGS. 13 and 14 show an alternative to the approach of FIGS. 11 and 12. Here, the leaf spring elements 22 and 23 that are connected to the sole plate 20 are, with the exception of the mid-foot portion, arranged in a central area of the sole plate 20 and are encompassed along the border of the sole plate by other cushioning elements, for example a horseshoe-shaped cushioning element 70 in the forefoot part and two separate cushioning elements 71 on the medial and the lateral side of the heel part. The cushioning elements 70 and 71 may include a foamed material or may be manufactured as structural cushioning elements 30 without foamed materials, as described above. An exemplary arrangement of an isolated leaf spring element 22 in the mid-foot portion is shown in FIG. 14. The leaf spring element 22 resiliently supports this part of the sole plate 20. It is possible to integrate further leaf spring elements into the sole plate 20, for example on the medial side and/or cross-wise as described with respect to the above embodiment of FIGS. 2 and 3. Also, the embodiment of FIGS. 13 and 14 avoids premature wear of the cushioning elements 70 and 71, since the leaf spring elements 22 and 23 substantially contribute to a restoring force during compression of the sole body. Because the leaf spring elements 22 and 23 project below the cushioning elements 70 and 71, progressive cushioning is ensured—at first essentially only the leaf spring elements 22 and 23 are deformed, and the cushioning elements 70 and 71 are only deformed upon further compression of the sole.

Figure 15:
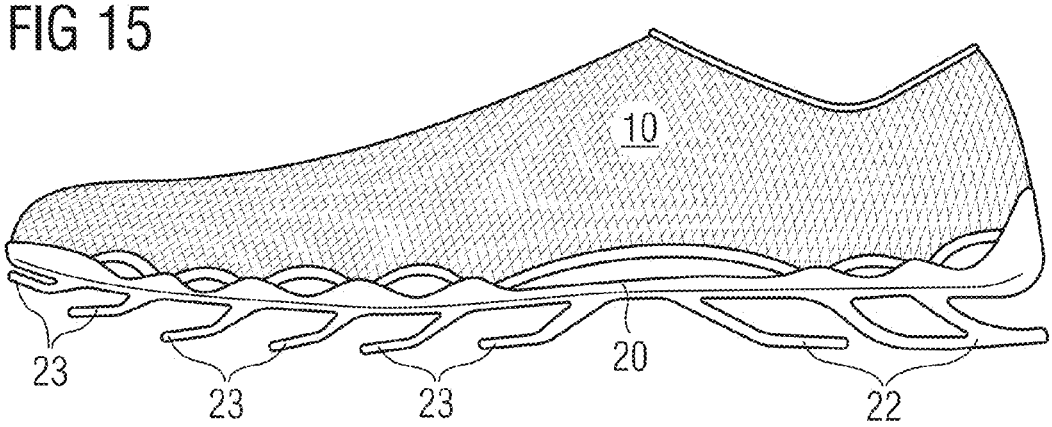
FIG. 15 is a schematic side view of a further embodiment of the present invention.
Figure 16:
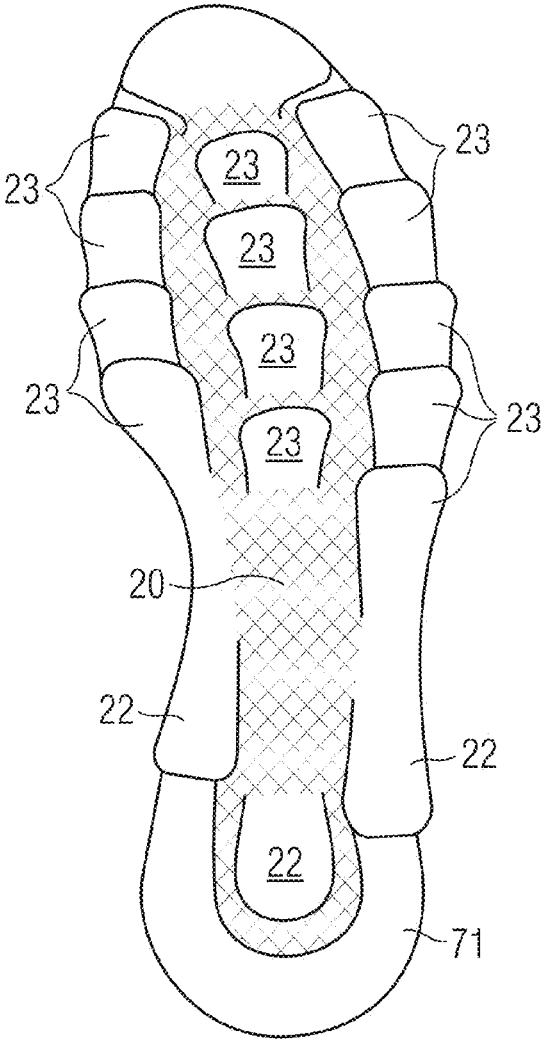
FIG. 16 is a bottom view of the embodiment of FIG. 15.

FIGS. 15 and 16 schematically present a further embodiment of the present invention, wherein no additional cushioning elements are provided and the leaf spring elements 22 and 23 are integrated into the sole plate 20. The leaf spring elements 22 and 23 are arranged in the heel part, in the mid-foot part, and in the forefoot part and extend substantially in a direction parallel to the longitudinal axis of the sole so that the free ends of the leaf spring elements 22 and 23 are either forwardly or rearwardly directed.

Also, in the embodiments of FIGS. 11 to 16, the sole plate 20 preferably includes an integrated heel cup 24 to provide the foot with the necessary lateral and medial stability and to avoid misorientations during heel strike. The integrated heel cup 24 can be formed of a variety of sizes to suit a variety of applications.

Figure 17:
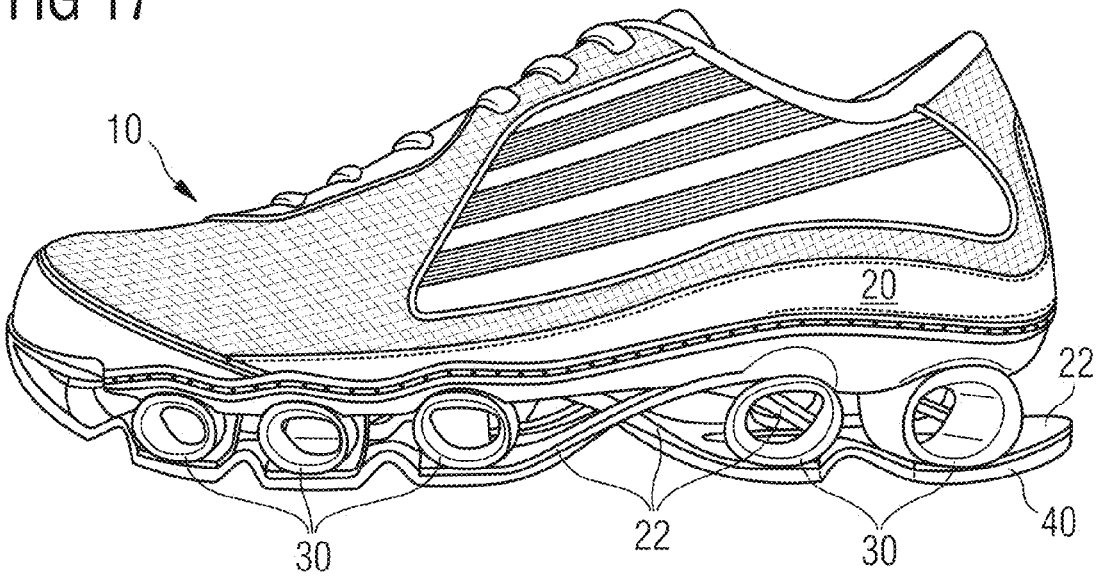
FIG. 17 is a schematic side view of a further embodiment of the present invention.
Figure 18:
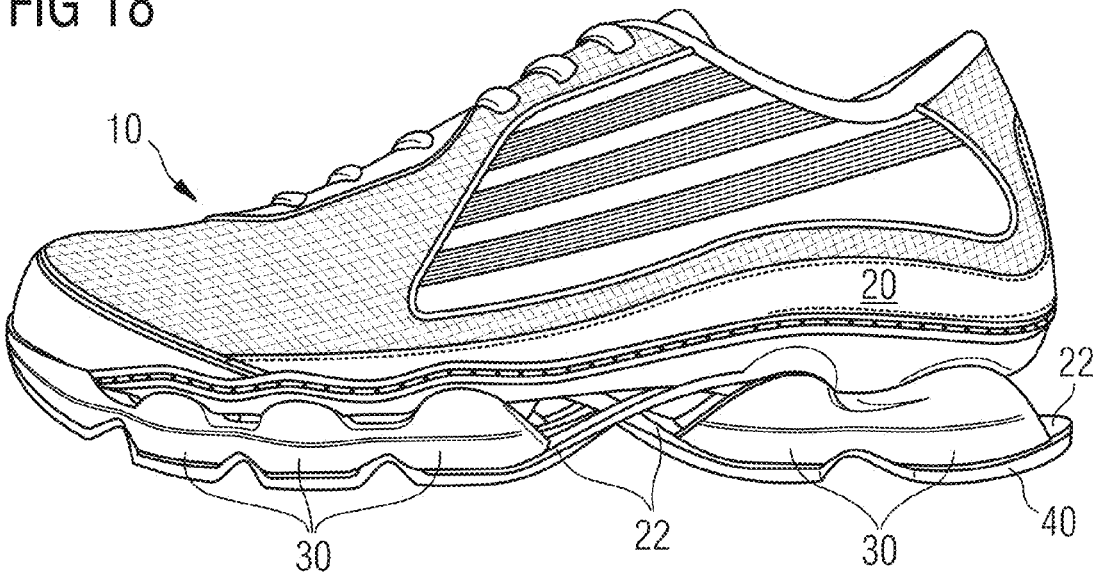
FIG. 18 is a schematic side view of a further embodiment of the present invention.

FIGS. 17 and 18 show two further embodiments of the present invention that do not have the optional cushioning element 35 at the rear end. This results in a softer cushioning characteristic at the heel strike since the rear end of the rearmost leaf spring element 22 can be deflected in an almost unhindered manner. Only when the focus of the load is shifted forward within the shoe during the early stage of the gait cycle are the rearmost cushioning elements 30 deformed. While the embodiment of FIG. 17 uses only structural cushioning elements, in the embodiment of FIG. 18 foamed cushioning elements are arranged between the leaf spring elements 22 and 23 and the sole plate 20. For manufacturing reasons, but also to improve the shearing stability, it is preferred if the cushioning elements 30 of the heel part and of the forefoot part are manufactured as a common component.

With the described embodiments the biomechanical properties of the sole can be specifically adapted to the loads that are to be expected for shoes of different size. Such fine-tuning cannot be easily realized for homogeneous midsoles made from a foamed material since it would require, for example, modification of the chemical composition of the midsole material depending on different sizes of the shoe. Such modification would result in substantially increased manufacturing costs.

FIGS. 19 to 25 illustrate further embodiments of the invention, similar to the embodiment of FIGS. 11 and 12, having leaf spring elements 22 and 23 that are interconnected at some of their free ends. As described above, leaf spring elements 22 and 23 each have one end that is fixed to sole plate 20 and one end that is not fixed to sole plate 20 (i.e., a free end). Due to its non-planar shape, a leaf spring element 22 or 23 curves away from the sole plate and provides a restoring force at its free end when deflected. Typically the restoring force exerts a force that has a component orthogonal to the sole plate (e.g., for cushioning) and a component parallel to the sole in the rearward direction (e.g., for acceleration). Further, the free end of the leaf spring element 22 or 23 is located away from the fixed end of the leaf spring element and therefore provides the restoring force at a location displaced from sole plate 20. These features are in contrast to a coil spring, which only provides a restoring force orthogonal to the sole and at the location where it is placed/fixed. Due to its mechanical configuration, a leaf spring is suitably adapted to provide a restoring force in situations where forces act not only in an orthogonal direction to the sole but also in a direction parallel to the sole, in particular parallel to the leaf spring element 22 or 23. Coil springs are less suitable in this situation. Leaf spring elements 22 and 23 have an enlarged cross-section at their fixed end, in order to facilitate fixation and to provide an increased deflection force at the free end.

As also described above, the free ends of leaf spring elements 22 and 23 may be interconnected. Interconnected leaf spring elements 22 and 23 provide a combined restoring force that substantially corresponds to the sum of the restoring forces of the individual leaf spring elements 22 and 23. The larger the number of interconnected free ends, the larger the potential restoring force. Interconnected free ends may therefore provide a significantly higher restoring force to a load than a single free end.

In an alternative embodiment, there may be cushioning elements placed between the free ends of leaf spring elements 22 or 23 and the sole plate, as illustrated above in connection with FIGS. 1 to 10, for example, and as mentioned above in connection with FIGS. 11 and 12.

In a further alternative embodiment (not illustrated), adjacent leaf spring elements are arranged so that a first deflecting leaf spring element touches the adjacent second spring element after a certain deformation and then also applies a force onto the adjacent second leaf spring element. The adjacent second spring element would then be deformed by the first spring element (similar to a chain reaction). This arrangement therefore leads to a delayed combined restoring force. In this way, adjacent spring elements would affect each other even if they are not interconnected with a "connection portion".

Figure 19:
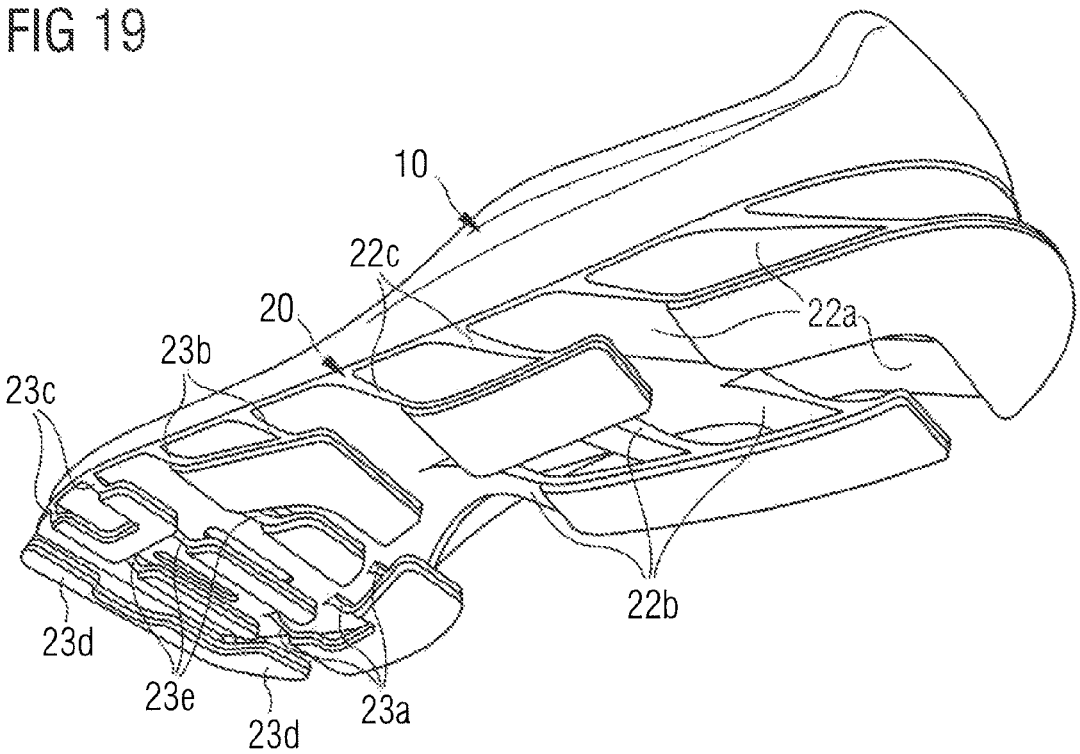
FIG. 19 is a perspective bottom view of a further embodiment of the present invention.

FIG. 19 is a perspective bottom view of a shoe with an upper 10 and a sole plate 20 having leaf spring elements 22 (22*a-c*) and 23 (23*a-e*). The first leaf spring elements 22 are arranged in the rear part of the sole, and the second leaf spring elements 23 are arranged in the front part of the sole.

FIG. 19 shows three groups of leaf spring elements 22*c*, 23*b*, and 23*c* arranged on a lateral side of the sole plate 20. In each group of leaf spring elements 22*c*, 23*b*, and 23*c*, the free ends are interconnected. FIG. 19 further shows two groups of leaf spring elements 22*b* and 23*a* arranged on a medial side of sole plate 20 and having interconnected free ends. Finally, FIG. 19 shows a group of leaf spring elements 23*e* arranged in the center of the forefoot region of sole plate 20, having interconnected free ends. In an embodiment not shown in FIG. 19, two or more leaf spring elements are arranged on a rear side of sole plate 20 and their free ends are interconnected.

First leaf spring elements 22*a* in FIG. 19 are arranged at the rear boundary laterally at sole plate 20 and are interconnected. Specifically, in the embodiment of FIG. 19 two leaf spring elements 22*a* arranged at the rear boundary and one leaf spring element 22*a* arranged at the lateral side are connected. Connecting multiple leaf spring elements 22*a* provides additional cushioning for the heel, which contacts the ground first in this region of the sole during the landing phase of the foot.

First leaf spring elements 22*b* in FIG. 19 are arranged at the medial side in the rear part of sole plate 20 and provide cushioning on this side of sole plate 20. Similarly, first leaf spring elements 22*c* provide cushioning on the lateral side of sole plate 20.

Second leaf spring elements 23 (23*a-e*) are arranged in the front part of the sole and include second leaf spring elements 23*a* (located at the medial side), second leaf spring elements 23*b* (located at the lateral side extending to the center part), second leaf spring elements 23*c* (located at the lateral side), second leaf spring elements 23*d* (located at the front side), and second leaf spring elements 23*e* (located at the center part), and provide cushioning in respective regions of sole plate 20.

The interconnection of leaf spring elements 22 and 23 in FIG. 19 is only an example. In other embodiments, leaf spring elements 22 and 23 may be connected in other regions, depending on the needs of the wearer. For example, all leaf spring elements located on a medial side or on a lateral side of sole plate 20 may be interconnected.

Figure 20:
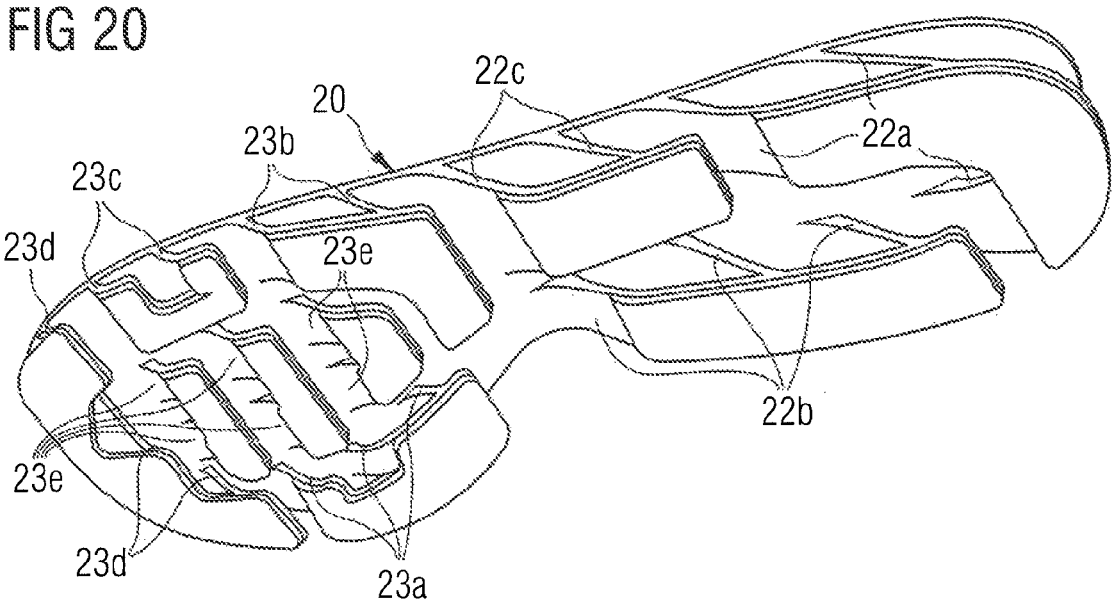
FIG. 20 is a different perspective bottom view of the sole of FIG. 19.

FIG. 20 is a different perspective bottom view of the embodiment of FIG. 19, without upper 10, in which the same reference characters designate the same elements as in FIG. 19.

Figure 21:
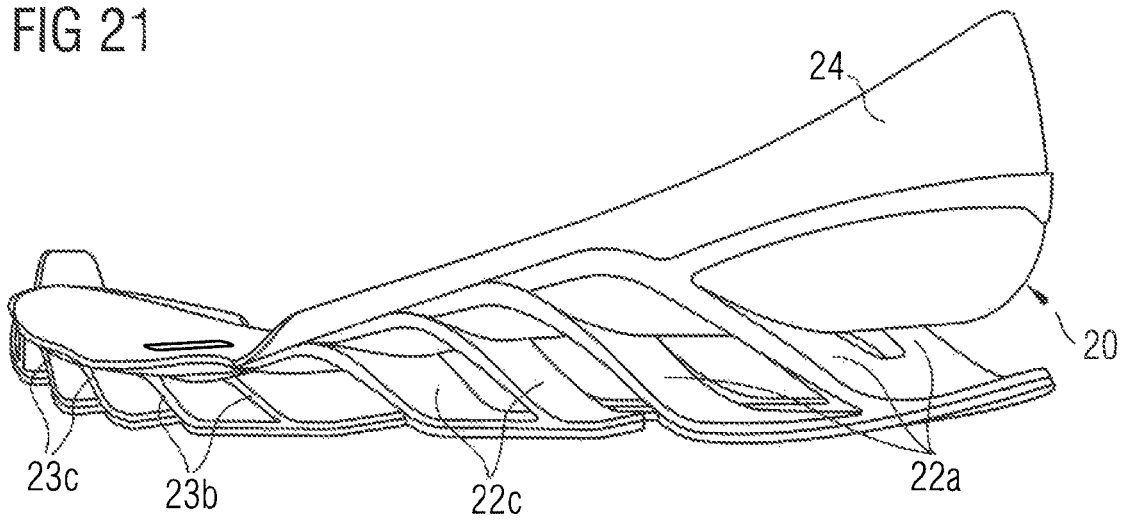
FIG. 21 is a perspective side view of a further embodiment of the present invention.

FIG. 21 is a perspective side view of a further embodiment in which the same reference characters designate similar elements as in FIGS. 19 and 20. In contrast to these figures, sole plate 20 includes heel cup 24.

Figure 22:
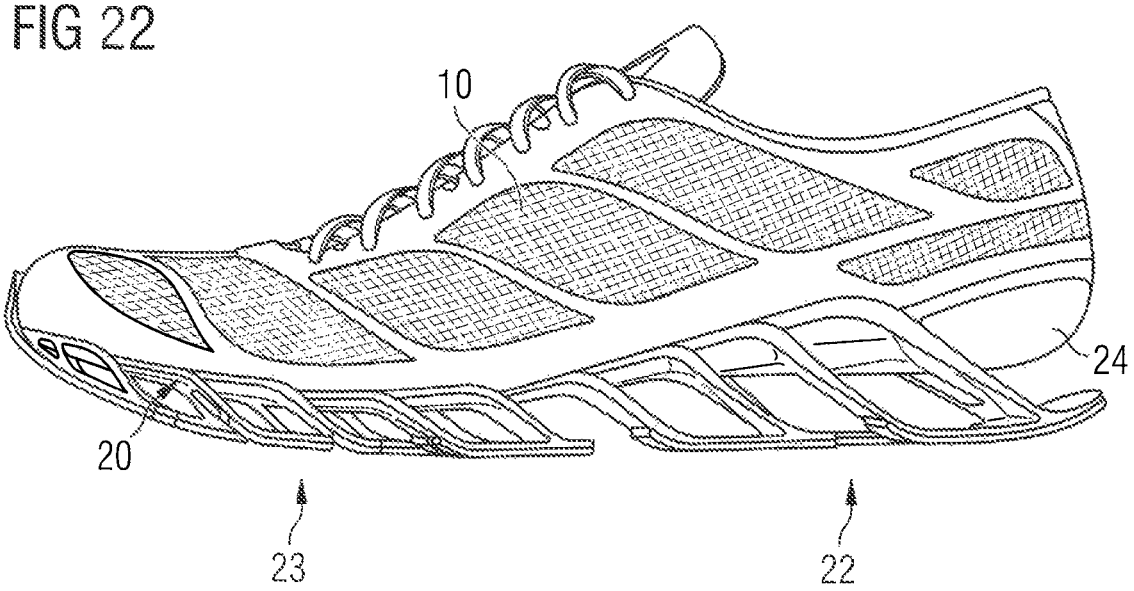
FIG. 22 is a perspective side view of a further embodiment of the present invention.

FIG. 22 is a perspective side view of a further embodiment including upper 10 and sole plate 20. Sole plate 20 includes heel cup 24.

Figure 23:
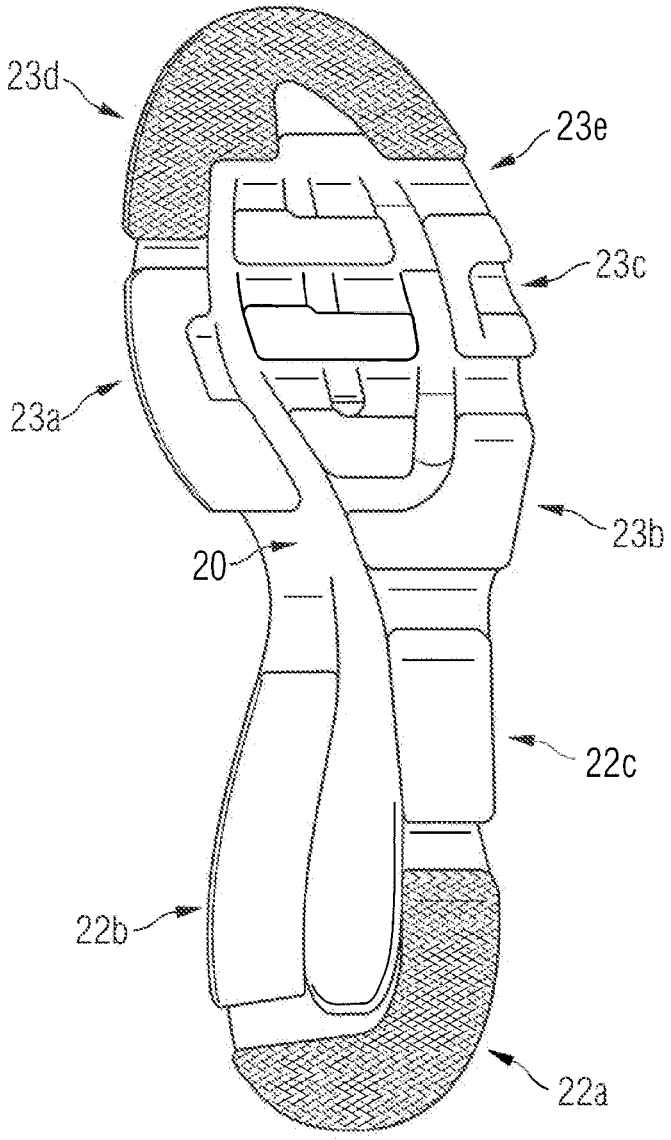
FIG. 23 is a bottom view of a further embodiment of the present invention.

FIG. 23 is a bottom view of a further embodiment of a sole in which the same reference numerals designate the same elements as in FIGS. 19 and 20. FIG. 23 illustrates the interconnection of leaf spring elements 22*a-c* and 23*a-e*, which form the outsole. Leaf spring elements 22*a-c* and 23*a-e* are hidden behind the interconnections in FIG. 23.

Figure 24:
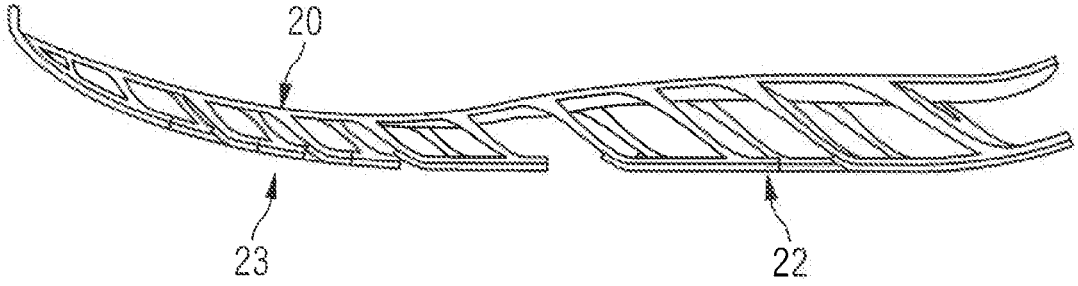
FIG. 24 is a side view of the sole of FIG. 23.

FIG. 24 is a side view of the sole shown in FIG. 23.

Figure 25:
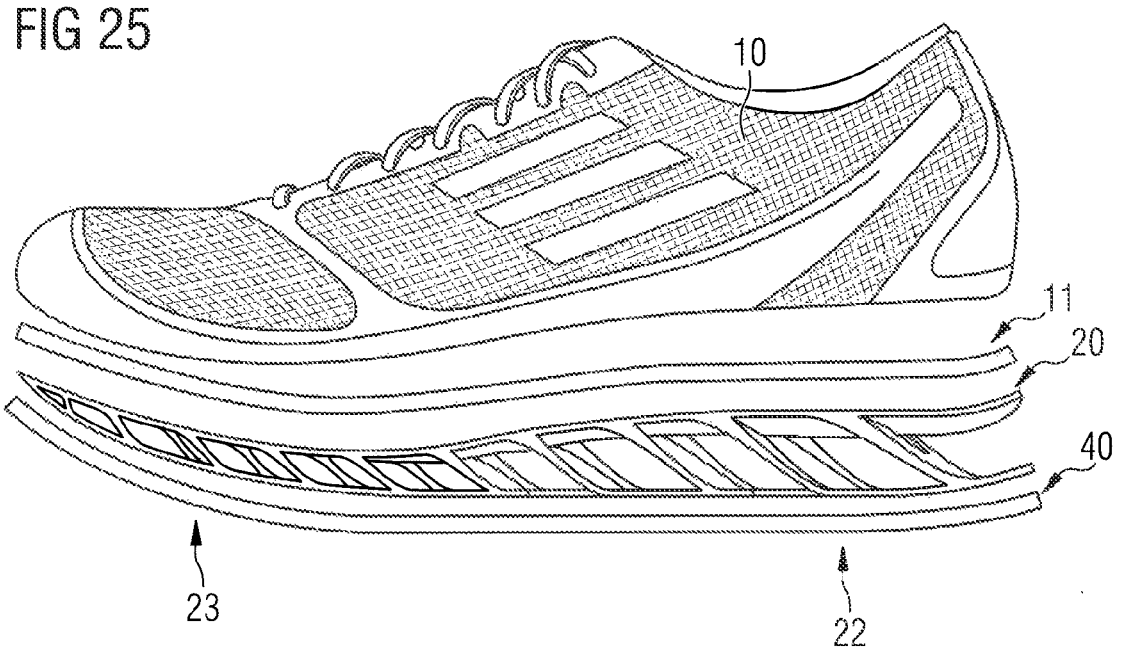
FIG. 25 is an exploded view of a further embodiment of the present invention.

FIG. 25 is an exploded view illustrating the assembly of a sports shoe including an upper 10, an (optional) sockliner 11, a sole plate 20 with leaf spring elements 22 and 23, and an outsole layer 40 that covers the free ends and/or the interconnections between the free ends of the leaf spring elements of sole plate 20. The outsole layer 40 may include interruptions or cut-outs.

Figure 26:
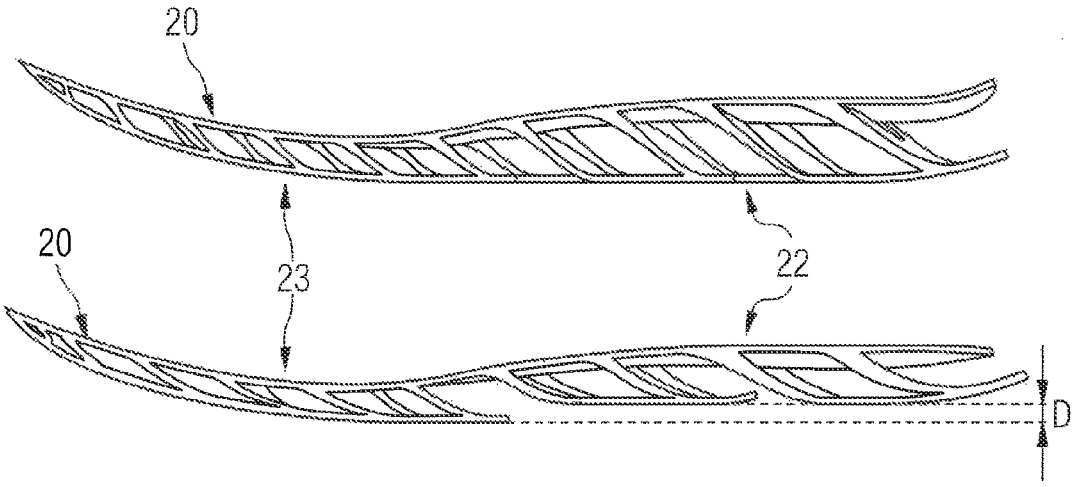
FIG. 26 is a side view of the sole of FIG. 25.

FIG. 26 shows two side views of the sole plate 20 of FIG. 25 with leaf spring elements 22 and 23. FIG. 26 illustrates that the degree of cushioning provided by leaf spring elements 22 and 23 depends on the distance between their free ends and the sole plate 20. As can be seen in FIG. 26, the first leaf spring elements 22 arranged in the rear part of the sole plate 20 are longer and have a greater distance between their free ends and the sole plate 20 as compared to the second leaf spring elements 23 arranged in the front part of sole plate 20. Therefore, the first leaf spring elements 22 provide a greater deflection and thus a higher degree of cushioning than the second leaf spring elements 23. Distance D indicates the difference between the degree of deflection provided by the first leaf spring elements 22 and the degree of deflection provided by the second leaf spring elements 23.

The deflection of a leaf spring element may be limited by constant factors, for example the cross section of its material at the point at which is it fixed to the sole plate. A sufficiently long leaf spring element may therefore provide a substantially higher degree of cushioning in relation to its length than a foamed material because the amount of compression of a foamed material depends on its dimensions. Therefore, with the same sole height more cushioning can be achieved; or with less sole height the same cushioning can be achieved.

Figure 27C:
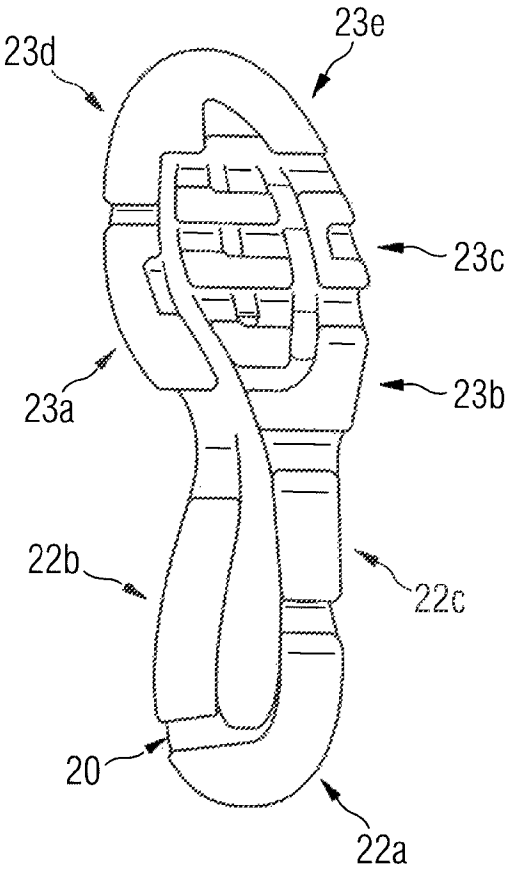
FIGS. 27*a-c* are bottom views of further embodiments of the present invention.
Figure 27B:
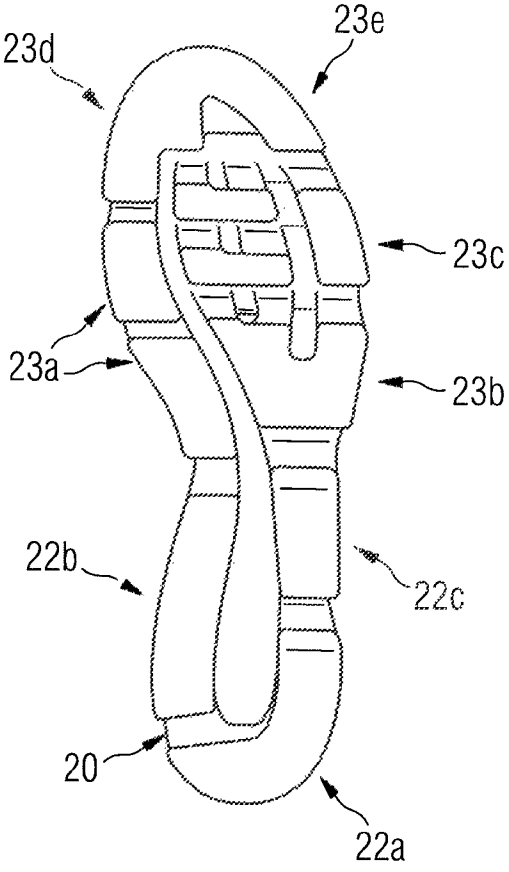
Figure 27A:
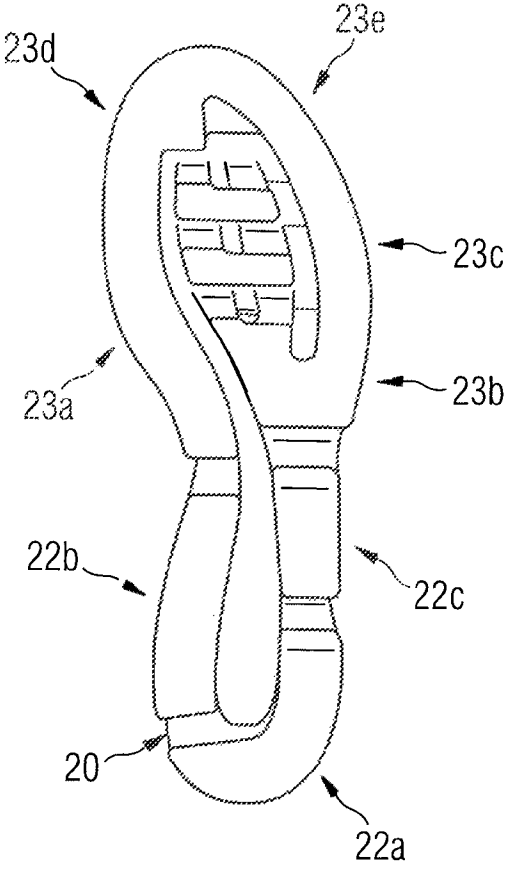
Figures 28A, 28B, 28C, 28D, 28E, 28F, 28G, 28H, 28I, 28J:
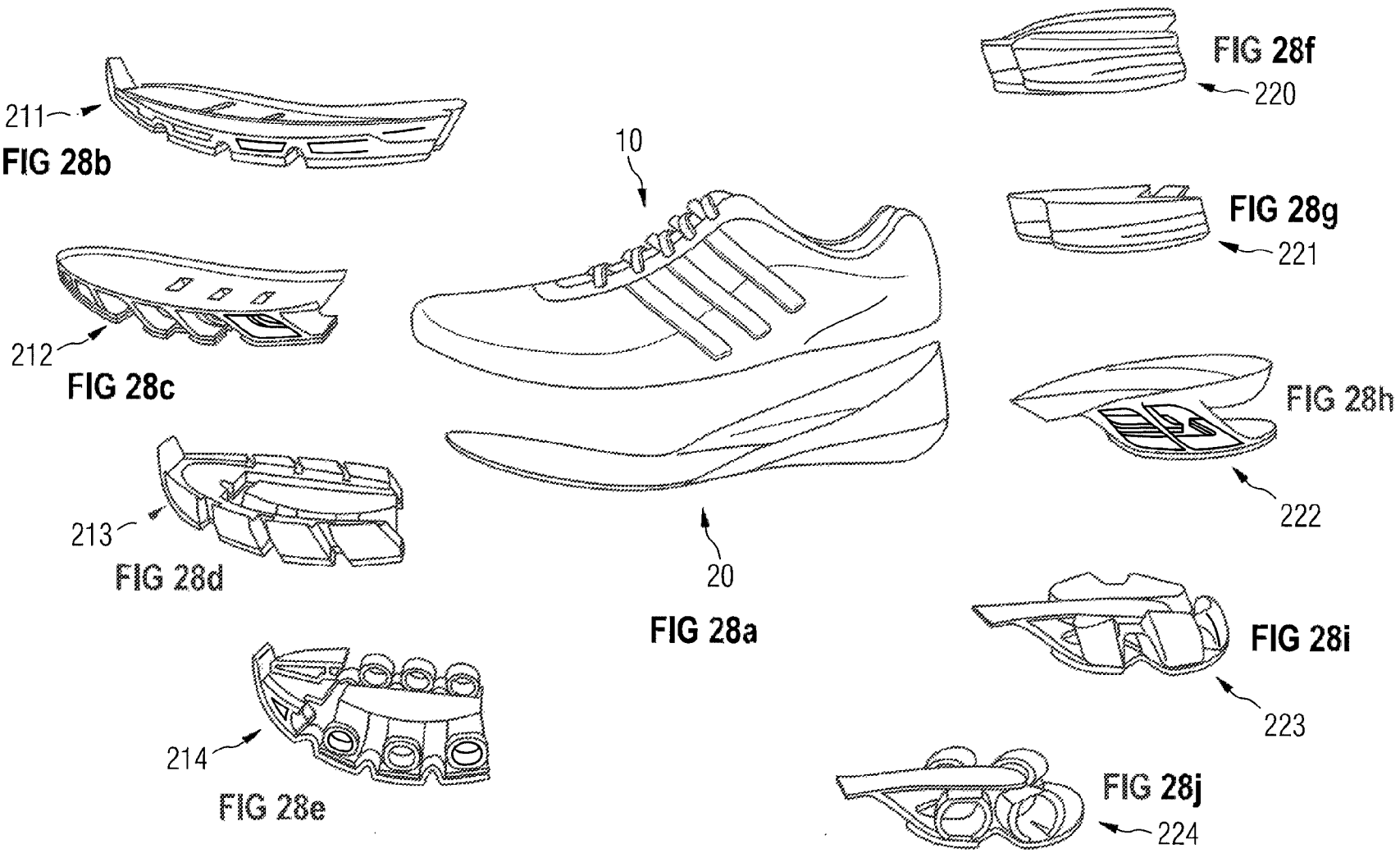
FIGS. 28*a-j* depict a modular system for cushioning of a shoe.

FIGS. 27*a-c* show three bottom views of different degrees of interconnection between free ends of second leaf spring elements 23 arranged in the front part of sole plate 20. In FIG. 27*a*, all leaf spring elements 23 along the boundary of the front part of sole plate 20 are connected and therefore provide the highest restoring force when deflected by a load. In FIG. 27*b*, this interconnection has been cut into five pieces (i.e., two medial parts 23*a*, a front part 23*d*, and two lateral parts 23*b* and 23*c*). Each of the parts 23*a-d* includes multiple connected leaf spring elements. This provides cushioning with a smaller restoring force but with higher flexibility due to different loads in different locations. FIG. 27*c* shows an alternative embodiment in which the medial part 23*a* remains a single piece and the lateral part 23*b* has been further divided into two pieces, providing a third center part 23*e*.

FIGS. 28*a-j* illustrate a further embodiment that relates to a modular system for providing cushioning of a shoe and that includes features independent from the other embodiments. This modular system allows different combinations of cushioning modules such as foam modules, leaf springs, structural elements, or sliding elements in different regions of the sole. It provides a high degree of adaptability to different external conditions (for example ground conditions and environmental conditions such as weather) as well as requirements of a user (for example purpose of use such as, for example, running, walking or climbing; desired degree of cushioning; specific personal conditions such as, for example, weight or protection for specific joints or muscles; or high life time cushioning element vs. comfort). Generally, the modular system enables a large variety of prefabricated shoes from a limited number of modules. Further, individual shoes can be manufactured on demand for a single user and components can be exchanged by the user as needed.

FIGS. 28*a-j* illustrate examples of cushioning modules that can be used with such a modular system. A first group of cushioning modules 211-214 (depicted in FIGS. 28*b-e*) described in the following is adapted for use in the forefoot region of sole plate 20.

Foam module 211 is made from foamed materials such as ethylene-vinyl-acetate (EVA) or polyurethane (PU), which provide excellent cushioning properties for typical loads arising in a shoe sole. The modular system may also include different foam modules that provide different degrees of cushioning depending on the materials used.

Leaf spring module 212 includes second leaf spring elements 23 with connected free ends as described above and overcomes disadvantages of foam elements, such as, for example, a limited lifetime and the dependence of material properties on environmental characteristics such as temperature, as also described above.

Leaf spring module with foam elements 213 additionally includes foam elements that are arranged between a free end of the leaf spring elements 23 and sole plate 20. As described above, in contrast to conventional midsoles, a longer lifetime of the foam element is to be expected in this embodiment since the foamed material must only cushion the deformation movement, whereas the actual restoring force against a deformation of the sole is provided by the elastically deflected leaf spring elements 213.

Leaf spring module with structures 214 additionally includes structural elements that are arranged between a free end of the leaf spring elements 23 and the sole plate. Examples of such structural elements are the cushioning elements 30 discussed above in connection with FIGS. 3-10.

A second group of cushioning modules 220-224 (depicted in FIGS. 28*f-*28*j*) is specifically adapted for use in the heel region of the sole. Foam module 221 corresponds to foam module 211 and is made from foamed materials such as ethylene-vinyl-acetate (EVA) or polyurethane (PU). Leaf spring module 222 corresponds to leaf spring module 212 and includes first leaf spring elements 22 with connected free ends. Further, leaf spring module 222 extends from the rear end to the lateral side of the sole to provide additional cushioning for the heel during the landing phase of the foot, as described above for the first leaf spring element 22 in connection with FIG. 19.

The second group of cushioning modules additionally includes sliding module 220, which is described in detail in European Patent Nos. EP 1402795 and EP 1402796. Sliding module 220 has an upper sliding surface and a lower sliding surface, wherein the lower sliding surface is arranged below the upper sliding surface so as to be slidable in at least two directions. This arrangement leads to a sliding movement of the surfaces that distributes the deceleration of the shoe over a larger time period. This in turn reduces the amount of force acting on the athlete and thereby the momentum transfer to the muscles and the bones. Since the sliding movement of the upper sliding surface relative to the lower sliding surface may occur in several directions, strains can be effectively reduced in two orthogonal directions (i.e., effectively in a plane).

The cushioning modules 211-214 and 220-224 can be fixed permanently to the sole by, for example, gluing and/or welding. In this way a large variety of soles adapted for specific purposes can be manufactured efficiently from a limited number of components, without the need for an individual design of each resulting shoe.

The various cushioning modules 211-214 and 220-224 may also be provided with means for removably fixing the various modules (e.g., upper, sole, and cushioning modules) to each other. Such means may include clip-in means, magnetic means, screws and related fixations, and any other means known to a person skilled in the relevant art. Attaching or releasing the components may be performed with specifically adapted tools, conventional tools, or no tools at all. This leads to a modular shoe that can be rapidly adapted by a user to different or changing needs (e.g., weather or ground conditions) or in which modules that have a shorter lifetime than others can be exchanged, for example a module with foam. A module may even be exchanged with an improved module which did not exist when the user bought the modular shoe.

The large number of possible designs can best be exploited by a system in which a user configures his or her desired shoe, which is then manufactured accordingly and delivered to the user. This can be facilitated by an online system in which the user is provided with different options (e.g., uppers, soles, cushioning modules, materials, and colors) from which he or she configures the desired shoe. The system may also help the user with the configuration by relating different functionalities (related to various desired factors, for example, ground conditions; environmental conditions such as, for example, weather; purpose of use such as, for example, running, walking, or climbing; degree of cushioning; specific personal conditions such as, for example, weight or protection for specific joints or muscles; or high life time cushioning element vs. comfort) to the respective elements of the modular system, thereby providing an individual solution to the problem posed by the user.

What is claimed is:

1. A sole for an article of footwear, the sole comprising:

a sole plate comprising a plurality of leaf spring elements disposed in a forefoot area of the sole plate, wherein the sole plate and the plurality of leaf spring elements are integrally formed, wherein each of the plurality of leaf spring elements has a connected end connected to the sole plate and a free end not directly connected to the sole plate, wherein the free end is rearwardly disposed from the connected end, wherein all free ends point in substantially the same direction, wherein the sole comprises no leaf spring element in the forefoot area of the sole plate having a free end pointing substantially opposite the direction in which the free ends of the plurality of leaf spring elements point, wherein at least one leaf spring element comprises a longitudinal section extending in a longitudinal direction of the sole and a transverse section extending from the longitudinal section in a transverse direction of the sole, and wherein two or more leaf spring elements come together integrally to form a single end not directly connected to the sole plate.

2. The sole of claim 1, wherein each of the plurality of leaf spring elements is disposed below the sole plate.

3. The sole of claim 1, wherein at least one of the plurality of leaf spring elements comprises a non-planar form and extends between an insole region and an outsole region of the sole.

4. The sole of claim 1, wherein at least one of the plurality of leaf spring elements comprises a region with a concave curvature and a region with a convex curvature.

5. The sole of claim 4, wherein the free end of the at least one of the plurality of leaf spring elements extends horizontally.

6. The sole of claim 4, wherein the free end of the at least one of the plurality of leaf spring elements is substantially parallel with the sole plate.

7. The sole of claim 4, wherein an inflection point between the region with the concave curvature and the region with the convex curvature is spaced apart from and below a lower side of the sole plate.

8. The sole of claim 1, wherein the sole plate extends substantially from a toe area of the sole to a heel area of the sole.

9. The sole of claim 1, wherein the sole plate comprises a heel cup configured to encompass a heel of a wearer.

10. The sole of claim 1, further comprising a rear leaf spring element disposed on a rear side of the sole plate, and a lateral leaf spring element disposed on a lateral side of the sole plate.

11. The sole of claim 10, wherein free ends of the rear leaf spring element and the lateral leaf spring element are interconnected by an interconnection portion. material.

12. The sole of claim 1, further comprising an upper, wherein the upper is at least partially sewn to the sole plate.

13. The sole of claim 1, wherein the sole plate comprises a second plurality of leaf spring elements disposed in a rearfoot area of the sole plate, and wherein the rearfoot leaf spring elements are longer than the forefoot leaf spring elements.

14. The sole of claim 1, wherein the sole plate comprises a second plurality of leaf spring elements disposed in a rearfoot area of the sole plate, and wherein the rearfoot leaf spring elements have free ends disposed at a greater distance from the sole plate than the free ends of the forefoot leaf spring elements.

15. The sole of claim 1, wherein each of the plurality of leaf spring elements extends away from its connected end, and wherein a horizontal component of the direction of extension of each leaf spring element is only away from its connected end.

16. The sole of claim 1, wherein the sole comprises no leaf spring element in the forefoot area of the sole plate having a free end pointing substantially opposite the direction in which the free ends of the plurality of leaf spring elements point.

17. The sole of claim 1, wherein at least two leaf spring elements are connected to form the longitudinal section and the transverse section.

18. The sole of claim 17, wherein the at least two leaf spring elements connected to form the longitudinal section and transverse section are formed as a single piece.

19. The sole of claim 1, wherein the longitudinal section and the transverse section define an L-shape.

20. A sole for an article of footwear, the sole comprising:

a sole plate comprising a plurality of leaf spring elements disposed in a forefoot area of the sole plate, wherein each of the plurality of leaf spring elements has an end not directly connected to the sole plate, and wherein all ends not directly connected to the sole plate point in substantially the same direction, and wherein two or more leaf spring elements come together integrally to form a single end not directly connected to the sole plate.

21. The sole of claim 20, wherein the ends of at least two leaf spring elements not directly connected to the sole plate are interconnected by a connection portion.

22. The sole of claim 21, wherein the ends of the at least two interconnected leaf spring elements not directly connected to the sole plate are integrally formed with each other.

23. The sole of claim 20, wherein the sole plate and the plurality of leaf spring elements are integrally formed.

24. The sole of claim 20, wherein the two or more leaf spring elements forming a single end are formed as a single piece.

25. The sole of claim 20, further comprising a plurality of leaf spring elements disposed in a rearfoot area of the sole plate;

wherein the leaf spring elements comprise a foremost positioned leaf spring element having a foremost positioned end not directly connected to the sole plate and a rearmost positioned leaf spring element having a rearmost positioned end not directly connected to the sole plate, wherein the foremost leaf spring element and the rearmost leaf spring element have ends not directly connected to the sole plate that are oriented in substantially the same direction such that the end not directly connected to the sole plate is disposed rearward of its connection end, and wherein each leaf spring element disposed between the foremost leaf spring element and the rearmost leaf spring element has an end not directly connected to the sole plate that is oriented in substantially the same direction such that the end not directly connected to the sole plate of each leaf spring element is disposed rearward of its connection end.

26. A sole for an article of footwear, the sole comprising:

a sole plate comprising a plurality of leaf springs disposed in a rearfoot area of the sole plate and a plurality of leaf springs disposed in a forefoot area of the sole plate, wherein each of the plurality of leaf springs has a connection end connected to the sole plate and an end not directly connected to the sole plate, and where all ends not directly connected to the sole plate point in substantially the same direction, and wherein two or more leaf springs come together integrally to form a single end not directly connected to the sole plate.

27. The sole of claim 26, further comprising an outsole layer that interconnects the ends not directly connected to the sole plate of at least two leaf springs.

28. The sole of claim 26, wherein the two or more leaf springs that come together integrally to form a single end are disposed in the rearfoot area of the sole plate.

29. The sole of claim 26, wherein the sole plate and the plurality of leaf springs disposed in the rearfoot area of the sole plate and in the forefoot area of the sole plate are integrally formed.

30. The sole of claim 26, wherein the ends not directly connected to the sole plate are pointed in substantially the same direction such that the end of each leaf spring not directly connected to the sole plate is disposed rearward of its connection end.

31. The sole of claim 26, further comprising an outsole layer disposed on the single end of the two or more leaf springs that come together integrally to from the single end.

32. The sole of claim 26, wherein the two or more leaf springs that come together integrally to form a single end not directly connected to the sole plate are disposed adjacent to each other on the sole plate in a transverse direction between a lateral side of the sole plate and a medial side of the sole plate.

* * * * *